US008752511B2

(12) United States Patent
Hawkins et al.

(10) Patent No.: US 8,752,511 B2
(45) Date of Patent: Jun. 17, 2014

(54) MINATURE SLUDGE LANCE APPARATUS

(75) Inventors: Phillip J. Hawkins, Irwin, PA (US); Eric R. Haberman, White Oak, PA (US); Jerod J. Rudish, Cabot, PA (US); David W. Selfridge, Greensburg, PA (US)

(73) Assignee: Westinghouse Electric Company LLC, Cranberry Township, PA (US)

( * ) Notice: Subject to any disclaimer, the term of this patent is extended or adjusted under 35 U.S.C. 154(b) by 681 days.

(21) Appl. No.: 13/078,026

(22) Filed: Apr. 1, 2011

(65) Prior Publication Data

US 2011/0180022 A1 Jul. 28, 2011

Related U.S. Application Data

(63) Continuation of application No. 12/938,027, filed on Nov. 2, 2010, now Pat. No. 8,646,416.

(60) Provisional application No. 61/257,584, filed on Nov. 3, 2009, provisional application No. 61/258,794, filed on Nov. 6, 2009, provisional application No. 61/257,597, filed on Nov. 3, 2009.

(51) Int. Cl.
*F22B 37/48* (2006.01)

(52) U.S. Cl.
USPC ..... 122/379; 122/382; 376/316

(58) Field of Classification Search
CPC ..... F28G 2/00; F28G 15/02; F22B 37/56; F22B 37/48; F23J 3/023; B08B 9/0933
USPC ..... 122/379, 392, 382, 396, 399; 376/260, 376/316; 134/167 R, 172, 177, 200
See application file for complete search history.

(56) References Cited

U.S. PATENT DOCUMENTS

| | | | | |
|---|---|---|---|---|
| 4,572,284 | A * | 2/1986 | Katscher et al. | 165/95 |
| 5,320,072 | A * | 6/1994 | Theiss et al. | 122/382 |
| 5,667,139 | A * | 9/1997 | Dickie | 239/263.3 |
| 5,782,209 | A * | 7/1998 | Vandenberg | 122/379 |
| 5,782,255 | A * | 7/1998 | Magnin et al. | 134/167 R |
| 5,794,854 | A * | 8/1998 | Yie | 239/242 |
| 6,513,462 | B1 * | 2/2003 | Shiraishi et al. | 122/382 |
| 7,967,918 | B2 * | 6/2011 | Collin et al. | 134/167 R |
| 8,176,883 | B2 * | 5/2012 | Brown et al. | 122/379 |
| 8,238,510 | B2 * | 8/2012 | Haberman | 376/316 |
| 8,485,139 | B2 * | 7/2013 | Kim et al. | 122/379 |
| 2005/0045747 | A1 * | 3/2005 | Hacquebord | 239/525 |
| 2008/0121194 | A1 | 5/2008 | Prabhu et al. | |

* cited by examiner

*Primary Examiner* — Gregory A Wilson
(74) *Attorney, Agent, or Firm* — Richard J. Coldren; Westinghouse Electric Company LLC

(57) ABSTRACT

A miniature sludge lance for a steam generator in a pressurized water nuclear reactor is provided. The sludge lance is structured to enter the steam generator via an inspection opening and has a body sufficiently thin to fit between adjacent tubes. The sludge lance rail has at least two types of nozzle assemblies that may be attached thereto. One nozzle assembly rotates and another nozzle assembly translates in a vertical direction. A drive assembly, a mounting assembly, an oscillation assembly, and flow straighteners are also provided.

10 Claims, 22 Drawing Sheets

MINATURE SLUDGE LANCE APPARATUS

CROSS REFERENCE TO RELATED APPLICATIONS

This application is a continuation application of application Ser. No. 12/938,027, filed Nov. 2, 2010, entitled MINIATURE SLUDGE LANCE APPARATUS, which claims priority from provisional application Ser. No. 61/257,584, filed Nov. 3, 2009, entitled MINIATURE SLUDGE LANCE APPARATUS; 61/258,794, filed Nov. 6, 2009, entitled HAMMERHEAD; and 61/257,597, filed Nov. 3, 2009, entitled MINIATURE NOZZLE FLOW STRAIGHTENER FOR 90 DEGREE BEND.

BACKGROUND OF THE INVENTION

1. Field of the Invention

This invention relates to a cleaning device for a steam generator and, more specifically, to a miniature sludge lance structured to pass between adjacent tubes in the steam generator.

2. Description of the Prior Art

A pressurized water nuclear reactor utilizes a steam generator to maintain separation of the water that passes over the nuclear fuel (the "primary water") and the water that passes through the electricity generating turbines (the "secondary water"). The steam generator has an outer shell defining an enclosed space, at least one primary fluid inlet port, at least one primary fluid outlet port, at least one secondary fluid inlet port, at least one secondary steam outlet port, and a plurality of substantially uniformly sized tubes extending between, and in fluid communication with, the at least one primary fluid inlet port and at least one primary fluid outlet port. That is, the primary water passes through a manifold that divides the primary water into multiple streams that pass through the plurality of tubes. This manifold may be located inside or outside of the steam generator shell, but is preferably disposed inside the steam generator shell. The secondary water may also pass through a manifold, or simply multiple inlets/outlets, but is typically passed through a single inlet and a single outlet. A typical steam generator is cylindrical, about sixty feet tall and about twelve feet in diameter.

The tubes are disposed in a substantially regular pattern extending substantially vertically and having substantially uniform, narrow gaps between adjacent tubes. Further, the tubes typically have an overall shape of an inverted "U" and are coupled to a flat plate having a plurality of opening therethrough. This flat plate, or tube sheet, along with another plate that separates the at least one primary fluid inlet port and the at least one primary fluid outlet port, substantially forms the manifold noted above. Thus, within the steam generator shell, the tubes have an ascending side (hot) and a descending side (cool). Between these two sides there is a gap identified as the "tube lane." The steam generator shell has openings at various elevations and on either side of the tube lane. Typically, the openings are disposed in opposing pairs. A six inch diameter penetration for opening at the tube lane axis is typical. Since the tube lane is formed by the dome of U-shaped tubes, access to the center of the steam generator is generous along the tube lane.

In operation, the primary water is communicated through the tubes and the secondary water passes over the tubes. As this occurs, the secondary water is heated and the primary water is cooled. During operation of the pressurized water reactor steam generator, sediment is introduced on the secondary side as the secondary water changes to steam. This particulate sediment, or sludge, is deposited on most exposed surfaces including on the outer surface of the tubes and, primarily, on the top of the tube sheet. Periodic cleaning of the sediment is desirable to maintain good heat transfer and water flow in the steam generator. A typical cleaning is performed by sweeping high pressure and high volume water jets introduced along the tube lane axis of the steam generator where there is ample clearance. That is, a "lance" structured to spray high pressure water is moved through the tube lane and is structured to spray water generally laterally (i.e. generally perpendicular to the axis of the tube lane) and downwardly in between the tubes. This spray lifts most of the sludge off the tube sheet and removes sludge from the exposed sides of the tubes. The cleaning can be preceded by chemical treatment. This cleaning pattern, however, may leave sludge between the close pattern of tubes and is less effective at locations spaced from the tube lane.

It is further noted that, in order to regulate secondary side water flow patterns in the steam generator, devices called tube lane blocks have been installed in some steam generators. The tube lane blocks can prohibit access for cleaning equipment through the six inch penetration. Support plate structures (stay rods) located within the tube bundles of steam generators are other obstructions that can prevent effective cleaning. Due to various internal physical restrictions in the tube lane (the area generated along the centerline of the tube sheet by the minimum bend radius of the Row 1 tubes), the tube legs (either hot or cold depending on the location of the inlet nozzle) cannot be adequately cleaned by conventional lancing equipment mounted to the hand holes. Access to the tube bundle is further restricted by an arrangement of Tube Lane Blocking Devices (TLBD's) and a Blowdown Pipe positioned directly along the centerline of the hand hole in the tube lane.

In addition to tube lane access, some steam generators have smaller inspection penetrations, openings about two inches in diameter, located at various orientations and elevations about the steam generator. After entrance through an inspection penetration, access is limited by the gap between adjacent tubes. These openings are not typically used for cleaning because the problem is to accurately position and sweep high pressure cleaning jets and deliver high water volume within the confines of adjacent tube spacing and the inspection penetration. These penetrations can also be disposed several degrees from the center of the tube lane. Sludge lancing is typically not performed through these penetrations due to their physical size and location. Therefore, the tube lane in these steam generators is basically inaccessible and prone to accumulating sludge and debris under the blowdown pipe and between the TLBD's. In addition, certain utilities have forbidden hand-lancing with static jets that impinge directly on the tube sheet and adjacent steam generator tubing—this limits certain types of manual lancing that could be employed through the inspection penetrations to clean this region. Sludge lancing technicians are subjected to higher doses or radiation with equipment that does not provide an automated mechanical means of oscillation or rotation of the high velocity jets down the tube gaps.

It is further noted that, during steam generator cleaning (tube lane or inspection port access) high pressure and volume water is injected into the steam generator and is sprayed laterally relative to the longitudinal axis of the lance. That is, the water must be redirected 90 degrees to clean between tubes. Water turbulence from a 90 degree bend significantly increases the divergence of the exiting water jet.

SUMMARY OF THE INVENTION

Cleaning of the tube sheet and the outer surface of the tubes, or "sludge lancing," can be accomplished efficiently and, essentially, automatically through the inspection ports by introducing a cleaning tool, or "lance," through the inspection penetrations that are narrower than the tube gap (the space between adjacent tubes that are a function of the tube diameter and pitch). Providing, of course, that the lance can be aligned with a tube row and that the lance may be positioned to spray the high velocity jet generally parallel to the tube sheet. The inspection port lancing system disclosed below has the capability of being automatically indexed relative to tube bundle spacing and in one embodiment includes a simulated jet oscillation feature that translates rotary-to-linear motion for a high velocity lancing head suspended at the tube sheet level. This system reduces the time required to perform the sludge lancing, thus lowering the radiological dose.

The disclosed and claimed concept provides generally for a sludge lance structured to pass through the narrow tube gaps. The sludge lance includes a nozzle assembly having lateral nozzles. Thus, as the nozzle assembly is indexed, i.e. advanced a distance equal to a multiple of the tube gap spacing, a fluid may be sprayed through the tube gap cleaning adjacent tubes.

Preferably, the nozzle assembly includes multiple lateral nozzles spaced about a tube gap width apart. "Lateral nozzles" are structured to spray perpendicular to the longitudinal axis of the sludge lance. That is, as the sludge lance advances between two rows of tubes, the nozzles spray laterally thereby cleaning the two rows and several rows beyond. In this configuration, the nozzle assembly may be indexed multiple tube gaps between cleaning sprays. For example, if there are three nozzles, the nozzle assembly may spray between the first three tube gaps, then advance/index to the fourth-sixth tube gaps and spray again. Alternately, regardless of how many nozzles are on the nozzle assembly, the sludge lance may index one tube gap length at a time, thereby causing each tube gap (except the last) to be washed multiple times.

The disclosed and claimed concept further includes a segmented rail. The rail defines the passage through which the water, or other cleanser, passes prior to the nozzle assembly. The oval geometry of the water passage, and associated end seals, enables high fluid flow. Lower placement of the water passage balances the coupling loads and eliminates the need for internal support structures. The rail also includes a drive shaft structured to move the nozzle assembly. The nozzle assembly is coupled to a first end of the rail, the end that is inserted into the steam generator. A water manifold is coupled to the second end of the rail, the end that remains outside of the steam generator. Further, an oscillation assembly is disposed at the rail second end and is structured to provide motion to the drive shaft.

On one hand, it is desirable to have as few separate components inserted into the steam generator as that increases the chances of accidentally dropping a component in the steam generator. Thus, if there is only a single inspection opening, rather than opposed openings, at a certain orientation and elevation on the steam generator shell, a rail may be, essentially, as long as the diameter of the steam generator. On the other hand, steam generators are often located in confined spaces wherein an extended rail could not fit. Thus, preferably, the rail is segmented. That is, a plurality of similar rail assemblies are coupled together to form the rail. The rail assemblies may be a uniform length, thus reducing manufacturing costs, or, may be a variety of lengths so as to reduce the number of components while still being useful in a confined space. For example, rail assemblies having lengths of five, three, and two feet could be used to form a rail having a total length of ten feet, but could still be manipulated in building providing a six foot space about a steam generator.

The rail is moved longitudinally by a drive assembly. The drive assembly is structured to support and precisely index the rail. The drive assembly is disposed on a mounting assembly coupled to the inspection opening. The mounting assembly has an alignment (adjustment) device that allows the rail to be properly aligned with the tube gap between two rows. It is noted that a small misalignment adjacent the inspection opening may result in the first end of the rail contacting tubes as the rail is advanced. This is not desirable as movement of the lance may be restricted.

There are two nozzle assembly embodiments disclosed herein. Both nozzle assemblies may use the same rail and drive assembly, but each utilizes a different type of oscillatory motion. Thus, the oscillation assembly for each embodiment is slightly different. In one embodiment, oscillation is simulated by mechanically raising and lowering the nozzle assembly (containing the high velocity water jets) against the hydrostatic operating pressure developed by the jet geometry.

In another embodiment, the nozzle assembly is structured to rotate over an arc of 180 degrees. With opposing nozzles, this creates a spray covering 360 degrees. An anti-backlash mechanism permits accurate nozzle sweep orientation. That is, when a drive shaft is segmented, there is the possibility of the segments not maintaining their orientation relative to each other due to tolerances at the couplings. This misalignment is exacerbated when the high pressure water is sprayed. This is a disadvantage as the nozzle assembly must be oriented properly so as to pass through the tube gaps In this configuration, the miniature sludge lance provides quick, accurate, and repeatable setup.

BRIEF DESCRIPTION OF THE DRAWINGS

A further understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, "temporarily coupled" means that two components are coupled in a manner that allows for the components to be easily decoupled without damaging the components. "Temporarily coupled" components are easy to access or otherwise manipulate. For example, a nut on a bolt that is exposed is "temporarily coupled" while a nut on a bolt within a typical transmission case sealed by multiple fasteners is not "temporarily coupled."

As used herein, "correspond" indicates that two structural components are sized to engage each other with a minimum amount of friction. Thus, an opening which corresponds to a member is sized slightly larger than the member so that the member may pass through the opening with a minimum amount of friction.

As used herein, a "keyed coupling," a "keyed socket," a "keyed opening" and a "keyed end" mean that two components are structured to be temporarily fixed together. This may be accomplished by a fixed threaded connection or an extension or lug disposed in a bore or passage. The extension and socket have a cross-sectional shape that correspond to each other but are not circular. As such, the extension cannot rotate in the socket. Keyed elements may have a cross-sectional shape such as, but not limited to a hexagon (such as a common nut) a "D" shape, or a rectangle. Unless otherwise coupled, e.g. by welding or adhesive, or otherwise difficult to access, a keyed coupling provides a temporary coupling.

As used herein, the word "unitary" means a component is created as a single piece or unit. That is, a component that includes pieces that are created separately and then coupled together as a unit is not a "unitary" component or body.

As used herein, a body moving in a "longitudinal direction" means that the body moves in a direction aligned with the body's longitudinal axis.

As used herein, "operatively engage" when used in reference to gears, or other components having teeth, means that the teeth of the gears engage each other and the rotation of one gear causes the other gear to rotate as well.

Figure 1:
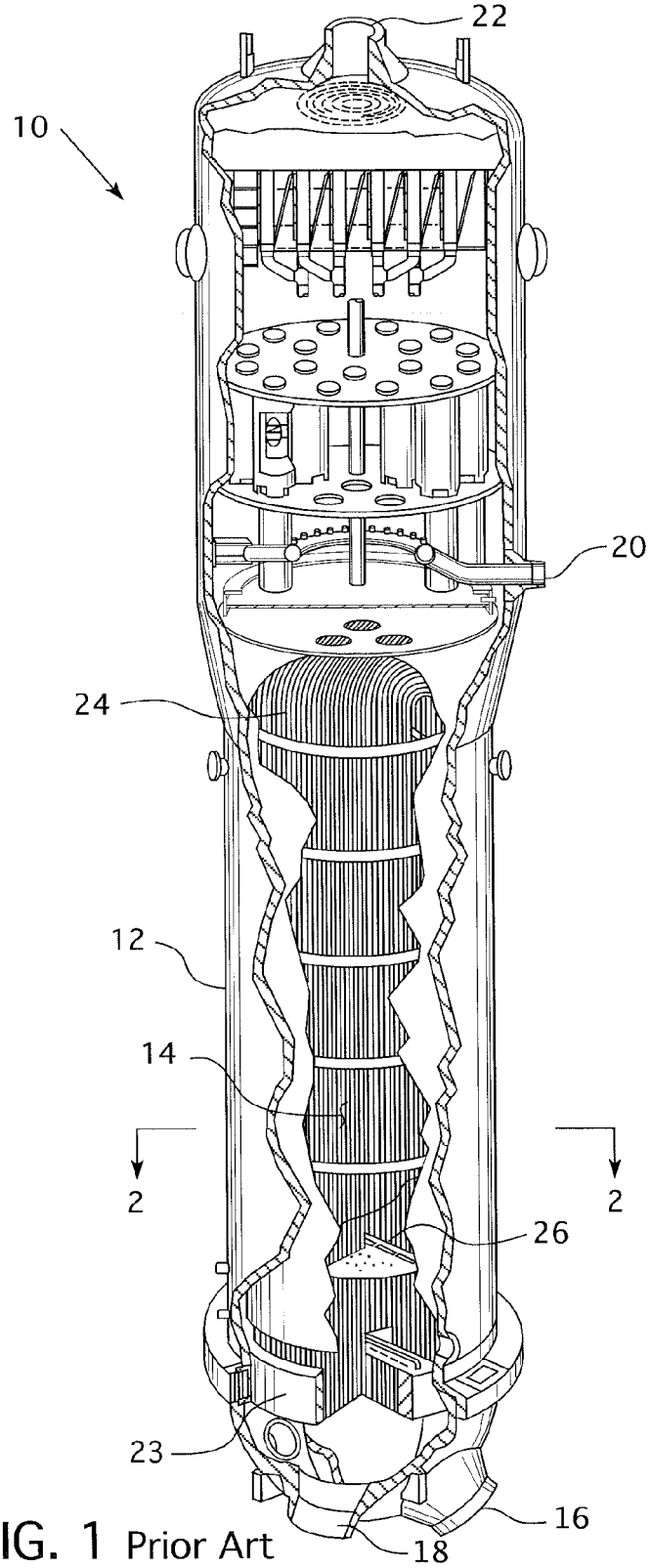
FIG. 1 Prior Art
FIG. 1 is an isometric, cut away view of a steam generator.
Figure 2:
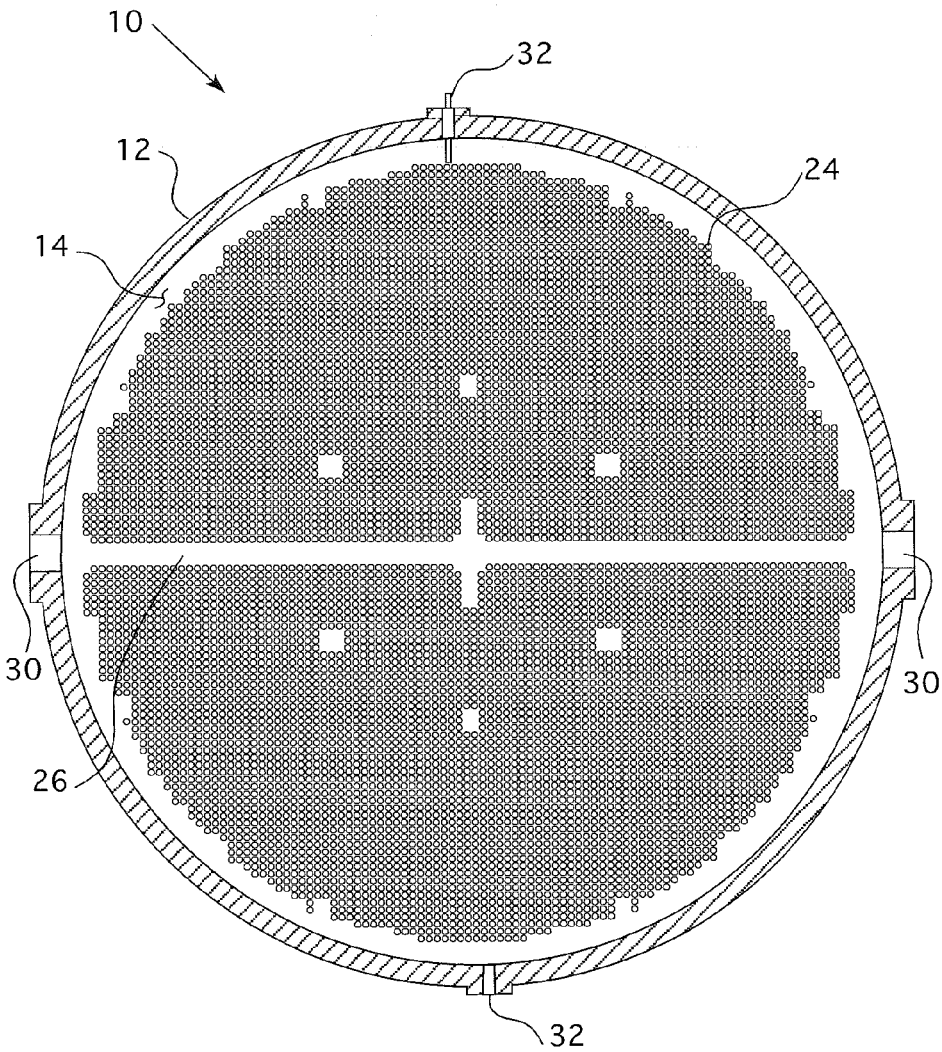
FIG. 2 Prior Art
FIG. 2 is a top cross-sectional view of the steam generator of FIG. 1.
Figure 3:
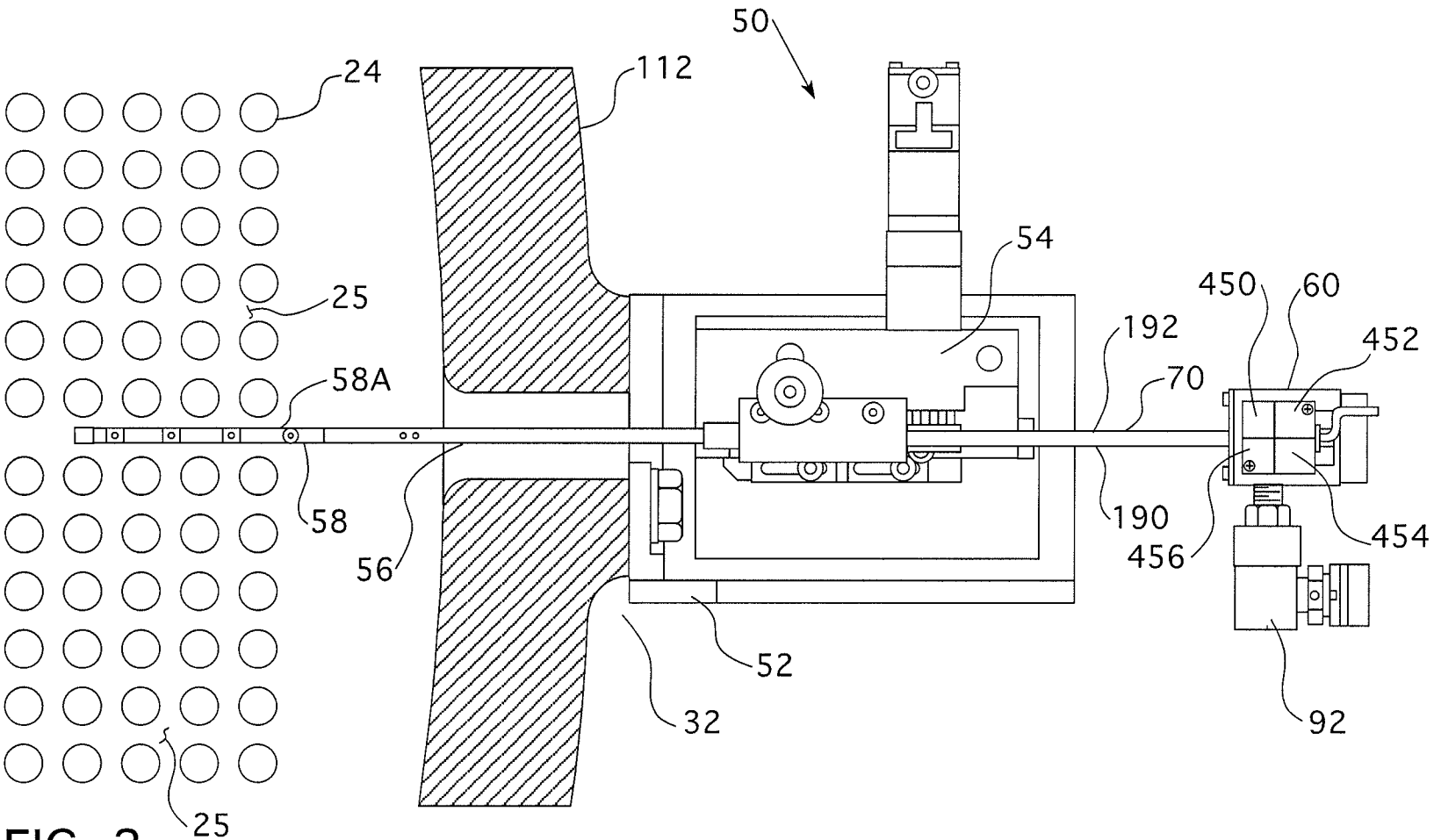
FIG. 3 is a detailed top cross-sectional view of the steam generator showing one embodiment of the miniature sludge lance.

FIGS. 1 and 2 show a steam generator 10 associated with a pressurized water nuclear reactor (not shown). A more complete description of a steam generator 10 is set forth in U.S. Patent Pub, 2008/0121194, which is incorporated by reference, generally however, the steam generator 10 includes an elongated, generally cylindrical shell 12 defining an enclosed space 14, at least one primary fluid inlet port 16, at least one primary fluid outlet port 18, at least one secondary fluid inlet port 20, at least one secondary fluid outlet port 22, and a plurality of substantially uniformly sized tubes 24 extending between, and in fluid communication with, the at least one primary fluid inlet port 16 and at least one primary fluid outlet port 18. The cylindrical shell 12 is typically oriented with the longitudinal axis extending substantially vertically. The tubes 24 are sealingly coupled to a tube sheet 23 that forms part of a manifold within the enclosed space that divides the fluid inlet port 16 and the fluid outlet port 18. As seen in FIG. 1, the tubes 24 generally follow a path shaped as an inverted "U." As seen in FIGS. 2 and 3, the tubes 24 are disposed in a substantially regular pattern having substantially uniform, narrow gaps 25 between adjacent tubes 24. The tube gap 25 is typically between about 0.29 and 0.41 inches, and more typically about 0.33 inches. Also, as shown, the "U" shape of the tubes 24 creates a tube lane 26 extending across the center of the shell 12. On both sides of the tube lane 26 there is tube lane access opening 30. A tube lane access opening 30, which is usually round, typically has a diameter of between about five and eight inches, and more typically about six inches. Further, the shell 12 has at least one inspection opening 32 disposed adjacent to said plurality of tubes 24 that is not aligned with the tube lane 26. An inspection opening 32, which is usually round, typically has a diameter of between about one and a half and four inches, and more typically about two inches. It is noted that the tube lane access opening 30 and inspection openings 32 can be located at multiple elevations on the shell 12.

During operation of the pressurized water nuclear reactor, heated, primary water from the reactor is passed through the tubes 24 via the at least one primary fluid inlet port 16 and removed from the steam generator 10 via the at least one primary fluid outlet port 18. Secondary water, enters the steam generator 10 via the at least one secondary fluid inlet port 20 and leaves the steam generator 10 via the at least one secondary steam outlet port 22. As the secondary water is passed over the outer surface of the tubes 24, the secondary water is converted to steam, leaving sludge between the tubes 24, on the tube sheet 23, and on other structures in the steam generator 10. Typically, access for a full sized sludge lance not shown) is through the tube lane access opening 30.

Figure 4:
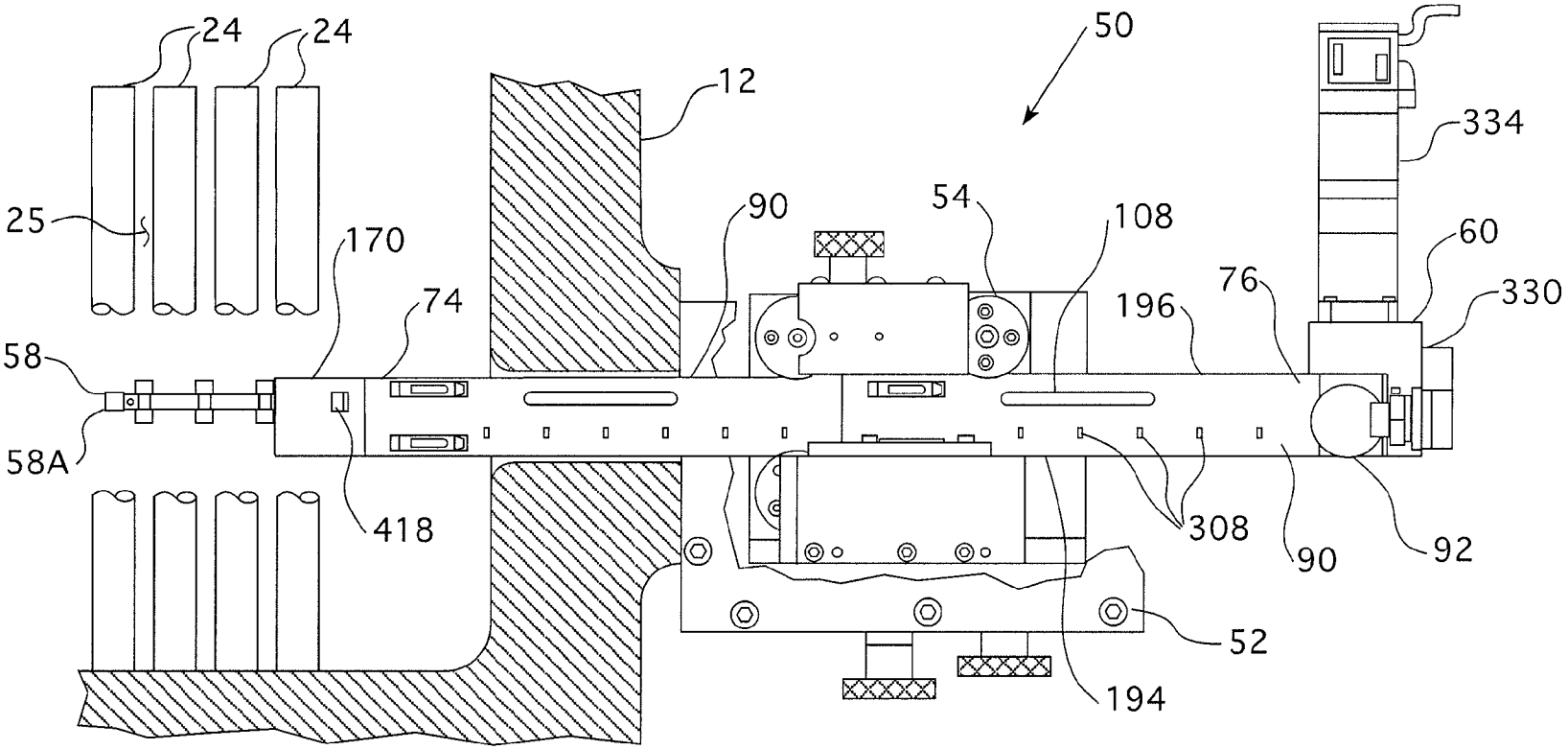
FIG. 4 is a detailed side cross-sectional view of the steam generator showing one embodiment of the miniature sludge lance.

As shown in FIGS. 3 and 4, a miniature sludge lance 50 includes a mounting assembly 52, a drive assembly 54, an elongated rail 56, a nozzle assembly 58, and, preferably, an oscillator assembly 60. The miniature sludge lance 50, unlike a full sized sludge lance, is structured to be inserted into the steam generator 10 via an inspection openings 32. Further, the portion of the miniature sludge lance 50 that passes into the steam generator 10, i.e. the rail 56 and nozzle assembly 58, is sized to pass between adjacent tubes 24, i.e. pass through the tube gaps 25.

Figure 5:
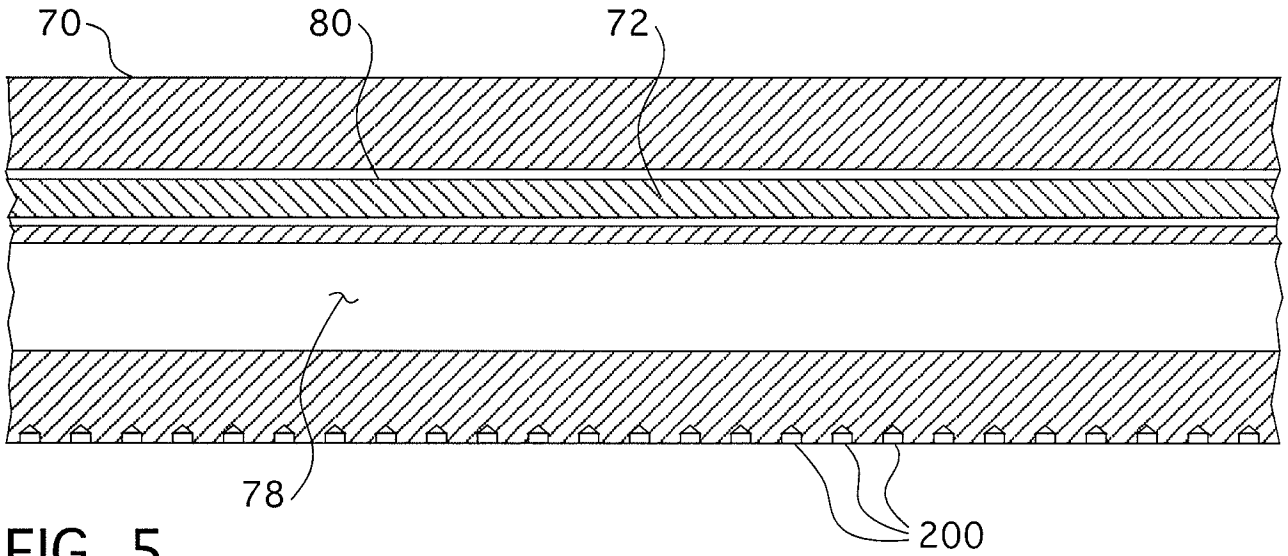
FIG. 5 is a cross-sectional side view of a portion of the rail.

The mounting assembly 52 is structured to support the drive assembly 54 and the rail 56. The drive assembly 54 is structured to move the rail 56 through the inspection opening 32. Further, the drive assembly 54 is coupled to the mount assembly 52. The rail 56 has a body 70 and a drive shaft 72 (FIG. 5). The rail body 70 has a first end 74 and a second end 76. Generally, as used herein, the rail body first end 74 is the end that is moved into the steam generator 10. As shown in FIG. 5, the rail body 70, as noted above, is sized to pass between adjacent tubes 24. The rail body 70 defines a water passage 78 and a drive shaft passage 80. The drive shaft 72 is rotatably disposed in the drive shaft passage 80. The rail body 70 is movably coupled to the drive assembly 54. The rail water passage 78 is structured to be coupled to, and in fluid communication with, a water supply (not shown), which is preferably a high pressure water supply. It is noted that the water may include a cleanser, or the fluid may be only a cleanser. As used herein, "water" means the fluid used to clean the tubes 24.

Figure 6:
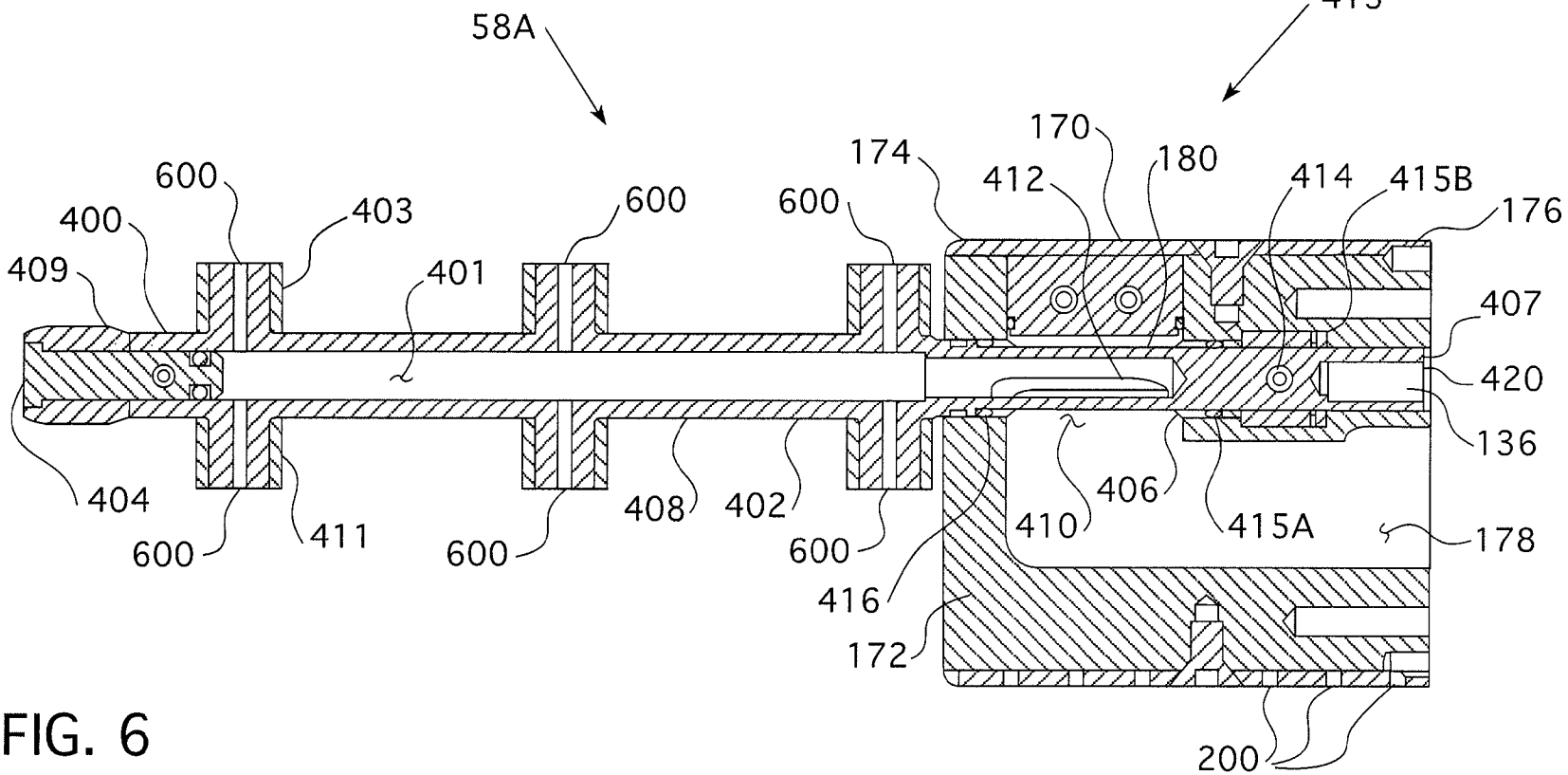
FIG. 6 is a cross-sectional side view of the head assembly and one embodiment of the nozzle assembly.

As shown in FIG. 6, the nozzle assembly 58 has a body assembly 400, 500 (FIG. 19) which, as noted above, is sized to pass between adjacent tubes 24. The nozzle assembly body assembly 400, 500 also defines a water passage 401. The nozzle assembly body assembly 400, 500 is coupled to the rail body 70 with the nozzle assembly body assembly water passage 401 being in fluid communication with the rail body water passage 78. In this configuration, as the rail body 70 is moved through the inspection opening 32, the nozzle assembly 58 passes between adjacent tubes 24. As the nozzle assembly 58 passes between adjacent tubes 24 and one purpose of the miniature sludge lance 50 is to clean multiple tubes 24, the water is preferably sprayed generally laterally, that is in a direction generally perpendicular to the longitudinal axis of the rail 56. More preferably, the water is sprayed at a slight downward angle so as to impinge upon sludge on the top of the tube sheet 23. Thus, the nozzle assembly body assembly 400, 500 is, preferably, elongated and includes at least two lateral nozzles 600. Preferably, the at least two lateral nozzles 600 are spaced longitudinally from each other on the nozzle assembly body assembly 400, 500, and, more preferably, the nozzles 600 are spaced substantially the same distance as between the centerline of two adjacent tubes 24, i.e. same distance as between the centerline of adjacent tube gaps 25. Further, the nozzle assembly 58 may include four nozzles 600, with the nozzles 600 disposed in opposing pairs. In this configuration the nozzles 600 in a pair face substantially opposite directions. Thus, the water is sprayed in two directions. The nozzle assembly 58 may be positioned at different tube gaps 25 and actuated. That is, the nozzle assembly 58 may spray high pressure water through the tube gaps 25 thereby cleaning the tubes 24 immediately adjacent the nozzle assembly 58 as well as several rows of tubes 24 therebeyond.

The miniature sludge lance 50 may utilize at least two different types of nozzle assemblies 58. Each of these nozzle assemblies 58, a rotating nozzle assembly 58A and a vertically reciprocating nozzle assembly 58B (FIG. 19) are detailed below. Each type of nozzle assembly 58A, 58B have an associated oscillator assembly 60A, 60B. The remaining components of the miniature sludge lance 50 may be used with any nozzle assembly 58. Accordingly, the following description shall address the common components first, then discuss the two types of nozzle assemblies 58A, 58B.

Figure 8:
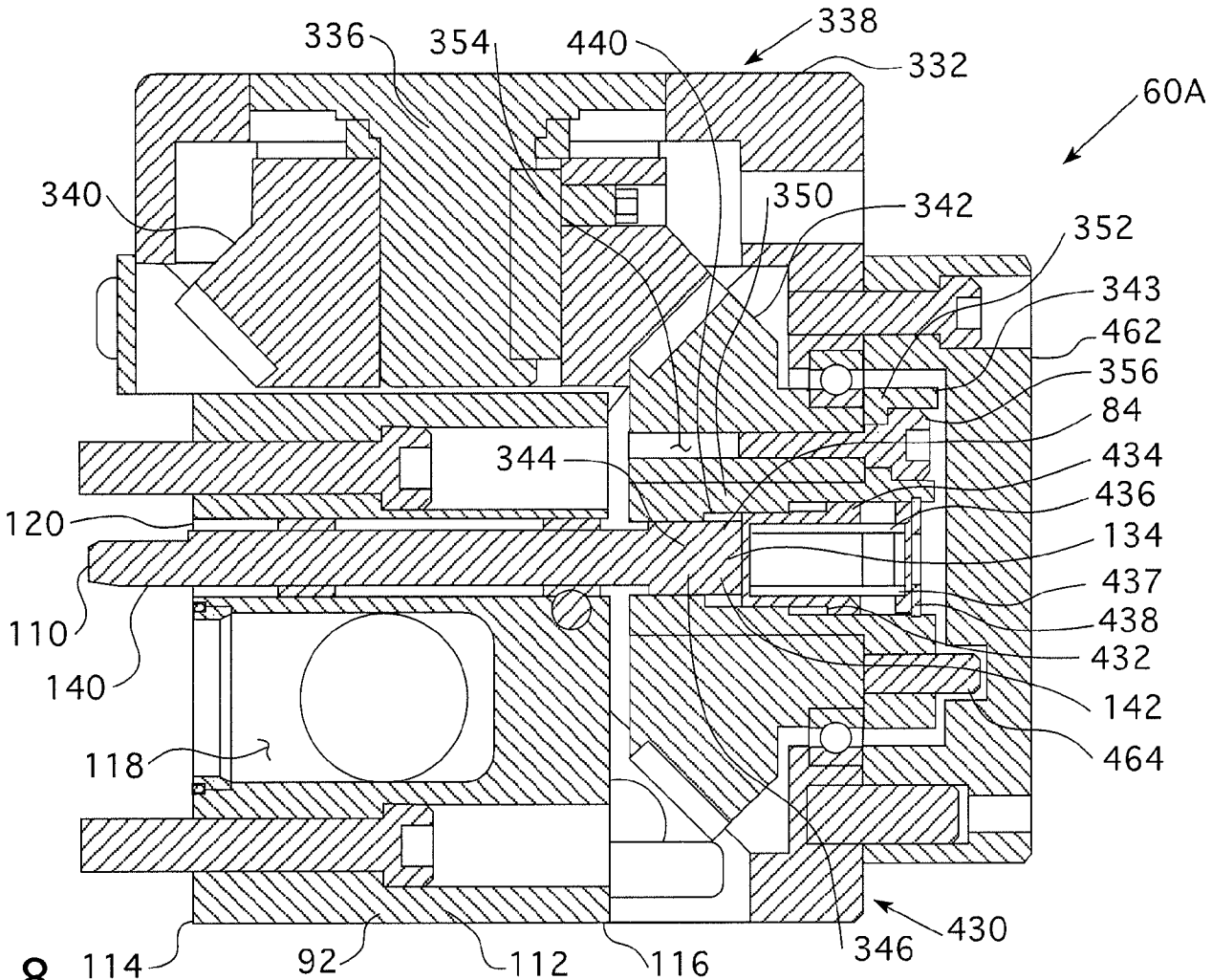
FIG. 8 is a cross-sectional side view of a portion of the oscillator assembly and the water manifold.

As noted above, the rail 56 has a body 70 and a drive shaft 72. The rail body 70 has a first end 74 and a second end 76. The rail body 70 is substantially rigid. The rail body 70 is sized to pass between adjacent tubes 24. The corners of the rail body 70 may be chamfered to reduce the chance of a sharp edge contacting the tubes 24. Preferably, the rail body 70 has a rectangular cross-sectional shape having a greater height than width. This configuration, as compared to another shape, e.g. a circular cross section, allows for the rail body water passage 78 to be larger so as to provide a sufficient amount of water. It is further noted that the rail body water passage 78, preferably, has an oval cross-sectional shape. This shape allows for a less turbulent flow as the water passes into the nozzle assembly 58. The rail body drive shaft passage 80 is, preferably, generally circular. The drive shaft 72 is generally circular. The drive shaft 72 has a first end 82 (FIG. 6) and second end 84 (FIG. 8). The drive shaft first and second ends 82, 84 are, preferably, a keyed coupling (key and keyed socket 134, 136, discussed below) or coupled to a key for a keyed coupling, as discussed below.

The rail body 70 has a sufficient length to reach all tubes 24 in a steam generator. Thus, if the steam generator shell 12 is ten feet in diameter, and every inspection opening 32 has an opposing inspection opening 32, the rail body 70 would be about five feet long. If the steam generator shell 12 is ten feet in diameter, and the inspection openings 32 do not have an opposing opening, the rail body 70 would be about ten feet long.

Figure 7:
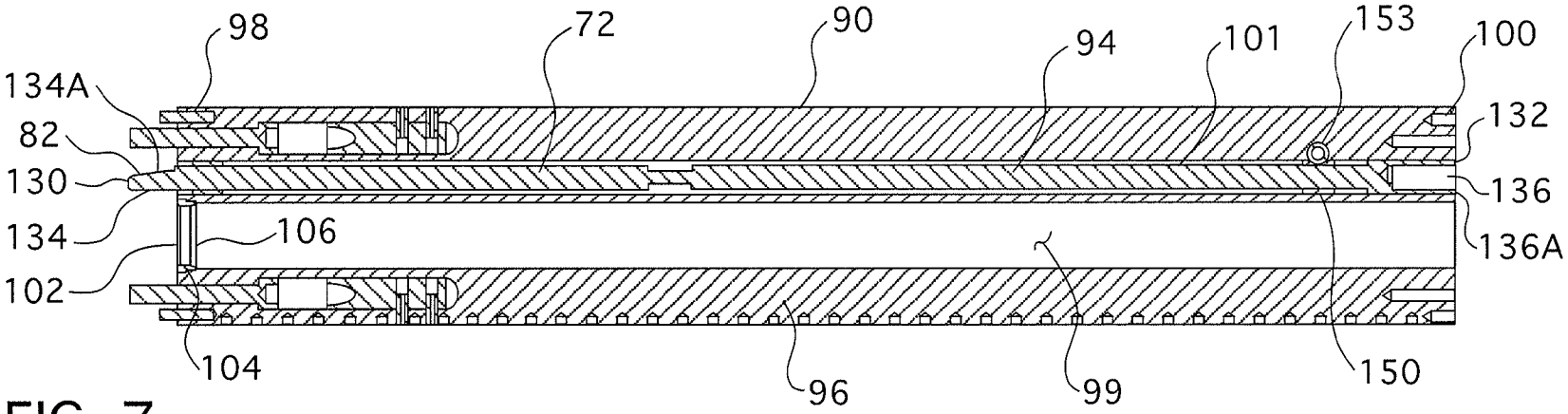
FIG. 7 is a cross-sectional side view of a rail assembly.

Steam generators 10, however, are not always disposed in a facility with a ten foot, or greater, clearance about the steam generator 10. Thus, the rail 56 may be segmented. That is, the rail 56 may include modular rail assemblies 90 and a water manifold 92 as shown in FIGS. 7 and 8. The rail assemblies 90 are structured to be coupled together and to be coupled to the water manifold 92 so as to form the rail 56. Thus, selected components to the rail 56, e.g. the drive shaft second end 84 are shown as part of selected assemblies. Each rail assembly 90 has a drive shaft segment 94 and an elongated body 96. As before, each rail assembly body 96 is elongated and has a first end 98 and a second end 100. Further, each rail assembly body 96 has a, preferably, rectangular cross section that defines a, preferably oval, water passage 99 and a generally circular drive shaft passage 101. Each rail assembly body 96 is sized to pass between adjacent tubes 24.

Further, each rail assembly body 96 includes a water passage seal 102. The rail assembly body water passage seal 102 may be disposed at either, or both, rail assembly body ends 98, 100, but is preferably disposed at the rail assembly body first end 98. That is, for each rail assembly body 96 there is an associated seal 102 at the rail assembly body first end 98. When the rail assembly bodies 96 are coupled together, as described below, the each water passage seal 102 is structured to sealingly engage the adjacent rail assembly body 96. Each water passage seal 102 is, preferably, disposed in a recess 104 in the axial face of the rail body first end 74. The seal recess 104 extends about the rail body water passage 78 and provides support for the water passage seal 102. Further, a seal support frame 106 may be disposed in the seal recess 104 to provide additional support to the seal 102. Further, each rail assembly body 96 may have a longitudinal window 108 therein. The longitudinal window 108 is aligned with, and provides communication with, the drive shaft passage 101. The longitudinal window 108 allows for easier manufacture of the drive shaft passage 101 (reduces the length the drive shaft passage 101 must be cut from each end of the rail assembly body 96), allows for holding the drive shaft segment 94 when coupling threaded drive shaft segments 94, and allows a user to observe the drive shaft segment 94 during use.

Each rail assembly body 96, preferably, has a substantially uniform length of between about 6.0 and 24.0 inches, and more preferably about 10.0 inches. Preferably, each rail assembly body 96 has a length in a multiple of the tube pitch. This allows interchangeability of rail assemblies 90. That is, for each steam generator 10 model (wherein the tube 24 spacing is substantially uniform) the rail assembly body 96 length being a multiple of the tube pitch allows for the spacing of the sprocket holes 200 and the positioning indicia 308, both discussed below, to be uniformly spaced on each rail assembly body 96. Alternatively, the rail assembly bodies 96 may have notably different lengths sized so as to minimize the number of rail assembly bodies 96 required to extend across the steam generator 10 while sized to fit within the facility in which the steam generator 10 is located. For example, for a steam generator 10 ten feet in diameter, the rail assembly bodies 96 may have lengths of five, three, and two feet.

As shown in FIG. 8, the water manifold 92 is structured to be coupled to, and in fluid communication with, a water supply (not shown), and preferably a high pressure water supply (not shown). The water manifold 92 has a drive shaft segment 110 and a body 112. The water manifold body 112 has a first end 114 and a second end 116. The water manifold body 112 defines a water passage 118 and a drive shaft passage 120. The water manifold body first end 114 is coupled to the second end 100 of the rail assembly body 96 disposed at the rail body second end 76. That is, as noted above the rail body second end 76 is the end of the rail body 70 that is located outside of the steam generator 10. Thus, regardless of how many rail assemblies 90 are used to form the rail 56, the water manifold 92 is coupled to the rail assembly body 96 at the rail body second end 76.

As noted above, the drive shaft 72 is an elongated, substantially cylindrical body structured to rotate in the drive shaft passage 80. When the drive shaft 72 is divided into drive shaft segments 94, as shown in FIG. 7, the drive shaft segments 94 are structured to be temporarily fixed to each other by couplings. That is, each drive shaft segment 94 has a first end 130 and a second end 132. The drive shaft segment ends 130, 132 are either an extension 134 or a socket 136; depending upon the nozzle assembly 58A, 58B used, each drive shaft segment first end 130 is either a key, such as a keyed extension 134A or a threaded extension 134B and each drive shaft segment second end 132 is either a keyed socket 136A or a threaded socket 136B. Further, as shown in FIG. 8, the water manifold drive shaft segment 110 has a first end 140 and a second end 142, both of which are either a keyed extension 134A or a threaded extension 134B, depending upon the type of drive shaft 72 in use. That is, the water manifold drive shaft segment first end 140 corresponds to the type of drive shaft segment socket 136 in use. When the rail body 70 is segmented, the water manifold drive shaft segment second end 142 is the drive shaft second end 84 as the water manifold drive shaft segment second end 142 is always located at the rail body second end 76. Thus, all drive shaft segments 94 and the water manifold drive shaft segment 110 may be temporarily fixed to each other to form the drive shaft 72.

Figure 9:
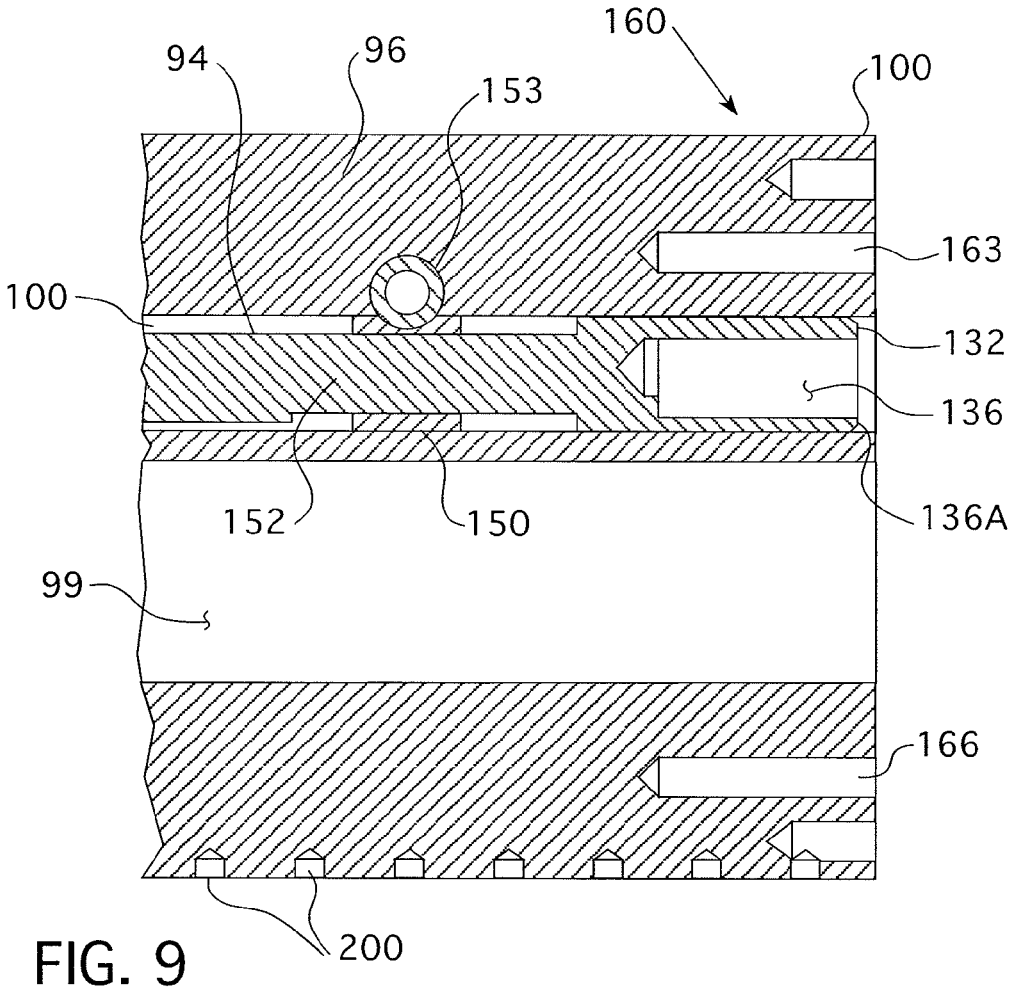
FIG. 9 is a cross-sectional side view of the second end of a rail assembly.
Figure 10:
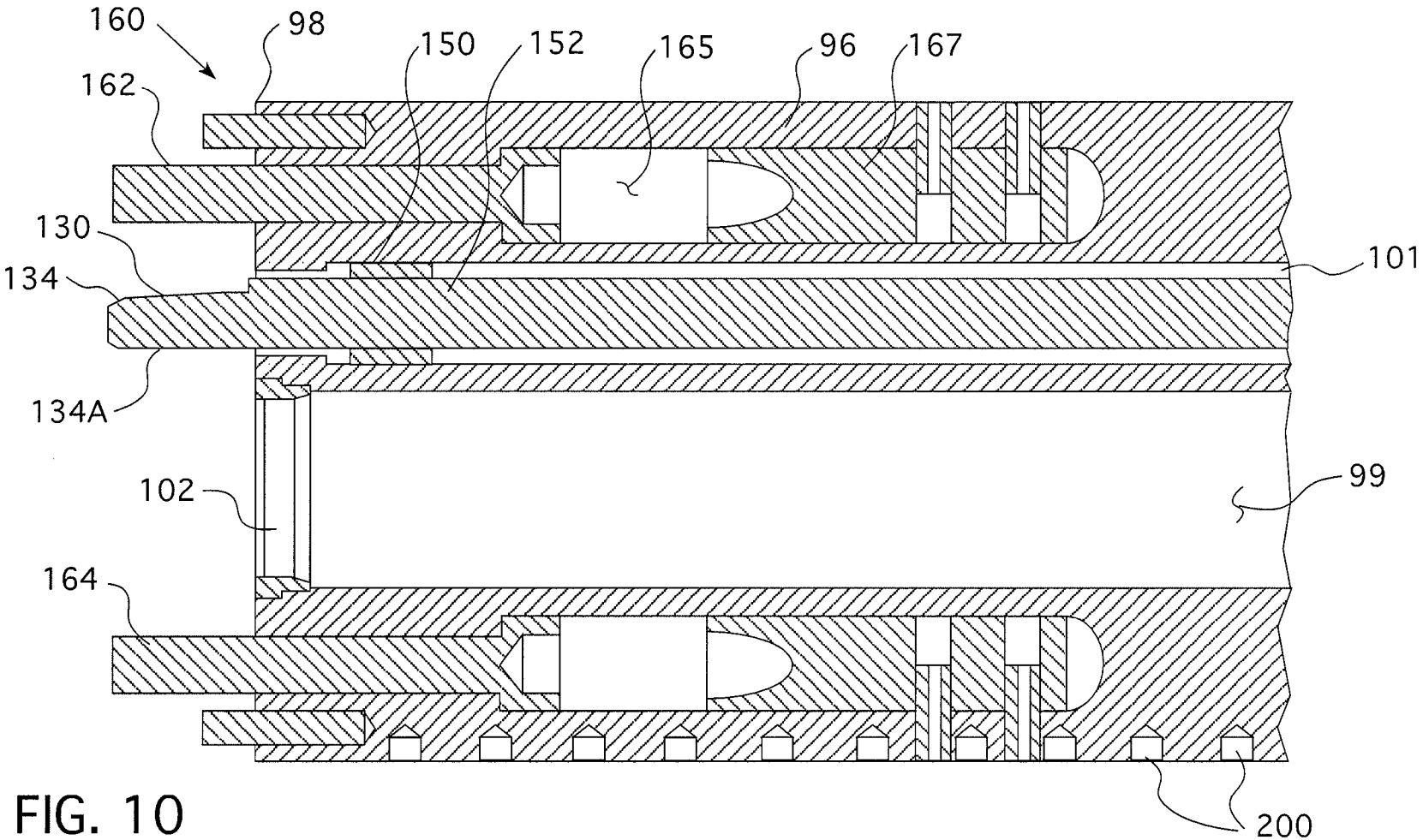
FIG. 10 is a cross-sectional side view of the first end of a rail assembly.

As detailed below, the drive shaft 72 is, preferably, structured to move in a longitudinal direction. As shown in FIGS. 9 and 10, this is assisted by at least one bearing 150 disposed between the drive shaft 72 and the rail body drive shaft passage 80. When the rail body 70 is segmented, there is at least one bearing 150 disposed between each drive shaft segment 94 and each rail assembly body drive shaft passage 101. More preferably there are two bearings 150 in each rail assembly body 96, one adjacent each drive shaft segment end 130, 132. The at least one bearing 150 is maintained in the desired location adjacent each drive shaft segment end 130, 132 by fixing the bearing to the rail assembly body 96 by a spring pin 153. Further, each drive shaft segment 94 includes at least one reduced diameter portion 152, and preferably one reduced diameter portion 152 per bearing 150. Each reduced diameter portion 152 forms a channel in which the bearing 150 is disposed. The ends of each reduced diameter portion 152 prevents the bearing 150 from moving beyond the reduced diameter portion 152. Because at least one bearing 150 is fixed in place relative to the rail assembly body 96, this has the effect of trapping the drive shaft segment 94 in the rail assembly body 96. More preferably, the reduced diameter portion 152 is longer than the associated bearing 150 thereby allowing the drive shaft segment 94 to move a small distance longitudinally relative to the rail assembly body 96. Each at least one bearing 150 has a length and each drive shaft segment reduced diameter portion 152 has an axial length that is greater than the at least one bearing 150 length. Preferably, with regard to the first embodiment discussed below, the relative lengths of the bearing 150 and the reduced diameter portion 152 allows the drive shaft segment 94 to move between 0.125 inch to 0.375 inch, and more preferably about 0.25 inch. It is noted that, for the second embodiment discussed below, the drive shaft segments 94 are structured to shift between about 1.0 inch and 2.0 inches, and more preferably about 1.25 inches.

Each rail assembly body 96 has a coupling assembly 160 disposed at each end 98, 100. Each rail body coupling assembly 160 is substantially the same so that any two rail bodies 70 may be coupled to each other. That is, each rail body coupling assembly 160 has a first component 162 and a second component 163. Each rail assembly body first end 98 has a coupling assembly first component 162 and each rail body second end 100 has a coupling assembly second component 163. Thus, the rail assembly bodies 96 may be coupled in series. Preferably, each coupling assembly first component 162 is at least one threaded fastener 164 and each coupling assembly second component 163 is at least one threaded bore 166. The at least one threaded fastener 164 is disposed in an elongated pocket 165 that extends generally longitudinally at the rail assembly body first end 98. A retaining body 167 may be disposed in the elongated pocket 165 and held in place by a spring pin 153. The retaining body 167 prevents the at least one threaded fastener 164 from being removed from the elongated pocket 165, thereby reducing the chance of a component falling into the steam generator 10.

One nozzle assembly 58A utilizes a head assembly 170 disposed at the rail body first end 74, as shown in FIG. 6. It is noted that if alternate nozzle assemblies 58A, 58B are not to be used, the elements of the head assembly 170 could be incorporated into the rail body 70. Thus, it is understood that the components described in relation to the head assembly 170 may also be considered to be part of the rail body 70. The head assembly 170 is structured to movably support the nozzle assembly 58A, as detailed below. The head assembly 170 has a body 172 with a first end 174 and a second end 176. The head assembly body 172 defines a, preferably oval, water passage 178 and a, generally circular, drive shaft passage 180. The head assembly body 172 is sized to pass between adjacent tubes 24. The head assembly body second end 176 is structured to be, and when assembled is, coupled to the first end 98 of the rail assembly body 96 disposed at said rail first end 74. That is, just as the water manifold 92 is disposed at the back end, i.e. the second end 76, of the rail 56, the head assembly 170 is disposed at the forward end, i.e. the first end 74, or the rail 56. Further, the head assembly body water passage 178 and drive shaft passage 180 are sized, shaped, and located to match with the rail body water passage 78 and rail body drive shaft passage 80, or, the adjacent rail assembly body water passage 99 and rail assembly body drive shaft passage 101. Further, the rail assembly body water passage seal 102 is structured to seal against the head assembly body 172. In this configuration, the head assembly body 172, the at least one rail assembly body 96 and the water manifold body 112 define the elongated rail water passage 78 and a drive shaft passage 80.

As noted above, the rail body 70, or the rail assembly bodies 96, are elongated and preferably have a rectangular cross-section. Thus, the rail body 70, or the rail assembly bodies 96, have two wide sides, hereinafter an outer face 190 (FIG. 3) and an inner face 192 (FIG. 3), and two narrow lateral sides 194, 196 (FIG. 4). One rail body lateral side 194 has a plurality of sprocket holes 200 (FIG. 5). When the rail 56 is formed from rail assembly bodies 96, the sprocket holes 200 maintain a consistent spacing over the interface between adjacent rail assembly bodies 96. The other rail body lateral side 196 is preferably, generally smooth. The sprocket holes 200 are structured to be engaged by the drive assembly 54.

Figure 11:
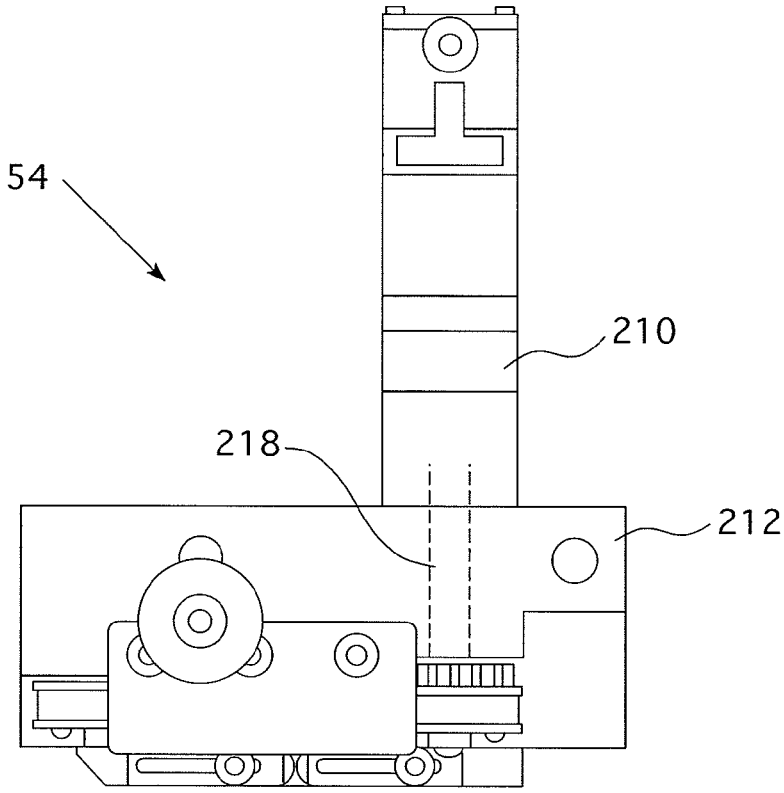
FIG. 11 is a top view of the drive assembly.
Figure 12:
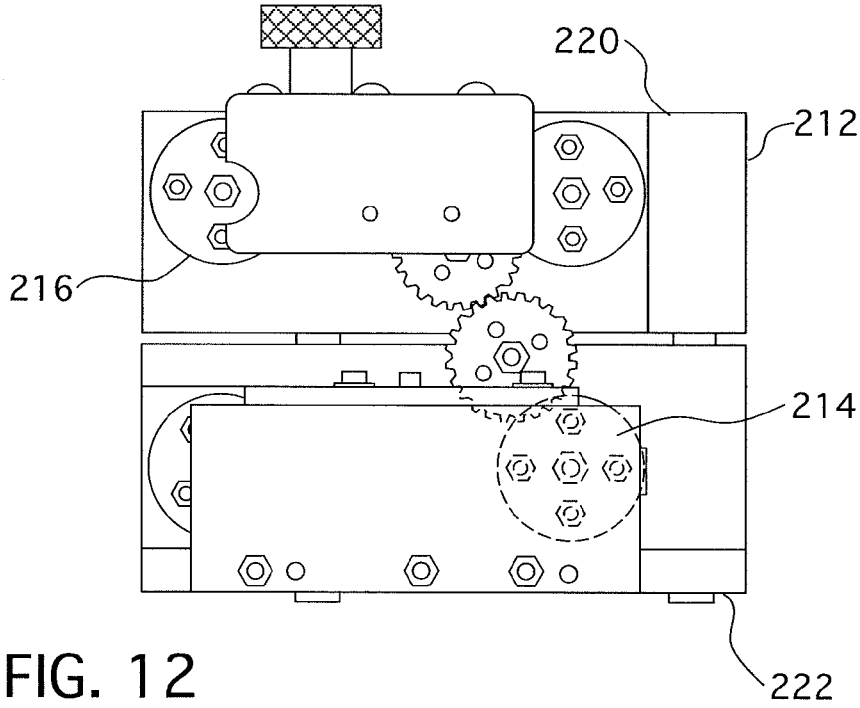
FIG. 12 is a side view of the drive assembly.
Figure 13:
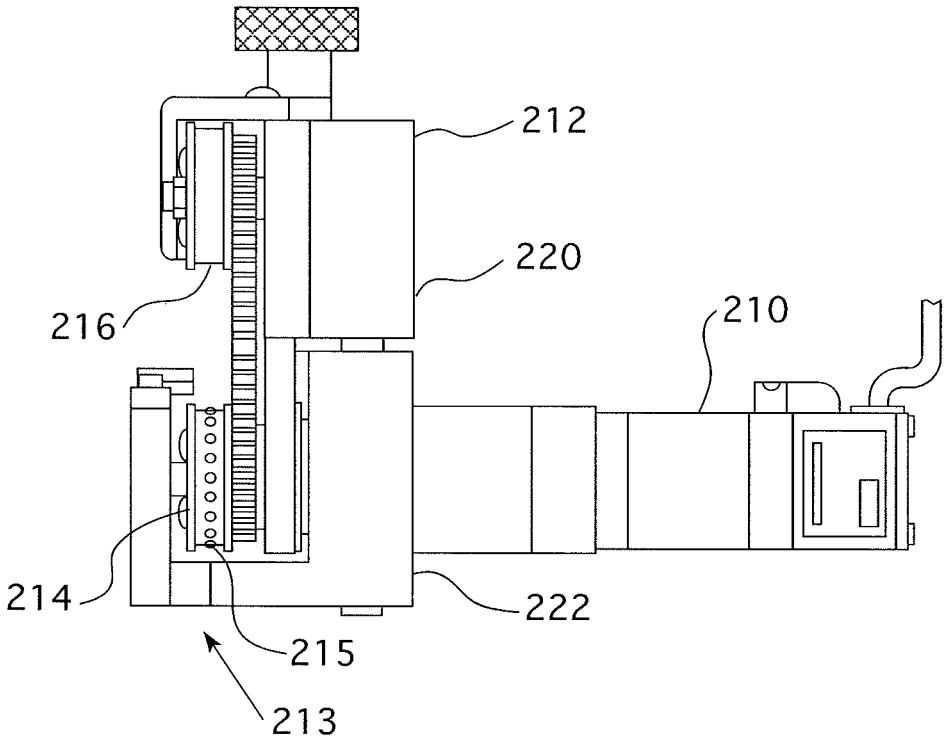
FIG. 13 is a back end view of the drive assembly.

As shown in FIGS. 11-13, the drive assembly 54 has a motor 210, a housing assembly 212, and a non-slip drive 213 and at least one guide surface 216. The non-slip drive 213 may be, but is not limited to, a gear system or a rack and pinion (not shown), but is preferably a drive sprocket 214. The motor 210 has an output shaft 218 and the drive assembly motor 210 is structured to rotate the drive assembly output shaft 218. The output shaft 218 is coupled to the drive sprocket 214. The at least one guide surface 216 is structured to maintain the rail body 70, or the rail assembly bodies 96, in contact with the drive sprocket 214. The rail body 70 is, or the rail assembly bodies 96 are, disposed between the guide surface 216 and the sprocket 214 with the sprocket holes 200 engaging the sprocket pins 215. Preferably, the sprocket pins 215 are involute. The drive assembly housing assembly 212 includes an upper case 220 and a lower case 222. The upper case 220 and the lower case 222 are movably coupled to each other and structured to translate relative to each other. More preferably, the upper case 220 and the lower case 222 are structured to move over a single axis in substantially the same plane, i.e. the upper case 220 and the lower case 222 translate in a plane while moving over a single axis.

Figure 14:
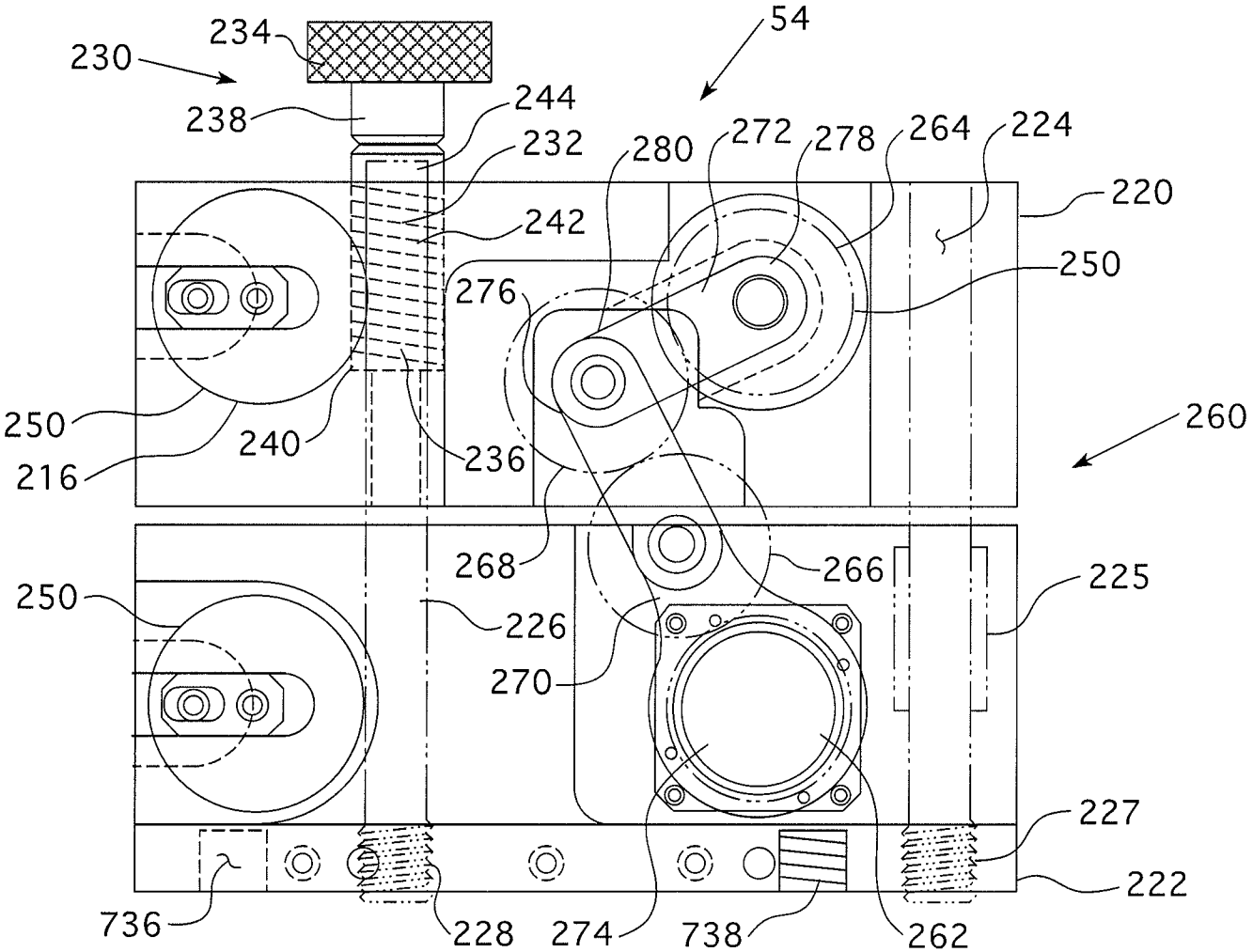
FIG. 14 is a schematic side view of the drive assembly.

As shown in FIG. 14, to accomplish this controlled motion of the upper case 220 and the lower case 222, the drive assembly housing assembly 212 includes two elongated guide pin passages 224 and two elongated guide pins 226. The guide pin passages 224 extend through both the upper case 220 and the lower case 222. That is, the guide pin passages 224 are bifurcated and aligned on each of the upper case 220 and the lower case 222. The guide pin passages 224 longitudinal axes are disposed in the same plane and extend substantially parallel to each other. Preferably, the guide pin passages 224 include a linear bearing 225 disposed in the lower case 222 guide pin passage 224. Further, the lower case 222 guide pin passage 224 preferably includes a threaded portion 227 and the guide pins 226 have corresponding threads 228, thereby allowing the guide pins 226 to be coupled to that passages 224. The guide pins 226 are disposed in the guide pin passages 224 and are, preferably, coupled to the lower case 222.

Further, the upper case 220 and the lower case 222 are structured to be biased toward each other. This bias causes components coupled to the upper case 220 and the lower case 222 to engage the lateral sides 194, 196 of the rail body 70. The bias may be affected by a device such as a tension spring coupled to both the upper case 220 and the lower case 222, but is preferably affected by a biasing assembly 230 on one guide pin 226. The guide pin biasing assembly 230 includes a biasing device 232, a knob 234, and a threaded end 236 on the associated guide pin 226. Further, the associated guide pin passage 224 has a portion 238 with a wider diameter whereby, when the guide pin 226 is disposed in the guide pin passage 224 having a portion 238 with a wider diameter, an annular space 240 is created. The guide pin passage 224 having a portion 238 with a wider diameter is, preferably, disposed in the upper portion of the bifurcated guide pin passage 224. The biasing device 232, which is preferably a compression spring 242, is disposed in the annular space 240. The guide pin threaded end 236 is disposed adjacent the upper case 220. That is, the guide pin threaded end 236 is in the upper portion of the bifurcated guide pin passage 224. The knob 234 has a threaded opening 244. The knob 234 is disposed on the guide pin threaded end 236. In this configuration, the biasing device 232 is disposed between the bottom of the annular space 240 and the knob 234. This configuration causes the biasing assembly 230 to bias the upper case 220 and the lower case 222 toward each other.

To accomplish the desired effect of components coupled to the upper case 220 and the lower case 222 engaging the lateral sides 194, 196 of the rail body 70, the drive sprocket 214 and the at least one guide surface 216 must be coupled to different portions of the drive assembly housing assembly 212. While the positions could be reversed, in the embodiment shown in the figures, the drive sprocket 214 is rotatably coupled to the lower case 222 and the at least one guide surface 216 is disposed on the upper case 220. In this configuration, the drive sprocket 214 and the at least one guide surface 216 engage opposing lateral sides 194, 196 of rail body 70. While the at least one guide surface 216 may be a cam surface, in the preferred embodiment, the at least one guide surface 216 is at least one guide wheel 250 rotatably attached to the upper case 220. For a greater degree of control of the rail body 70, the at least one guide wheel 250 may have three guide wheels 250. Preferably, the guide wheels 250 and the sprocket 214 (not the teeth 215 of the sprocket) have substantially the same diameter. The axes of the three guide wheels 250 and the sprocket 214 are disposed in a substantially rectangular pattern. This configuration effectively creates a longitudinal path through which the rail body 70 passes. It is noted that, if the guide wheels 250 and/or the sprocket 214 have different diameters, the same effect may be accomplished by three guide wheels 250 and the sprocket 214 being disposed in a quadrilateral pattern.

A system of guide wheels 250 is preferred over a cam surface so as to reduce wear and tear on the sides of the rail body 70 as the rail body 70 must be acted upon repeatedly by the guide wheels 250 and the sprocket 214. Wear and tear may be further reduced by causing at least the guide wheel 250 vertically opposing the sprocket 214 to rotate at the same rate as the sprocket. This is accomplished by a drive assembly gear assembly 260 that is coupled to the sprocket 214 and structured to rotate the at least one guide wheel 250. The drive assembly gear assembly 260 includes a first gear 262, a second gear 264, a third gear 266, a fourth gear 268, a first elongated link 270 and a second elongated link 272. The first gear 262 is fixed to the sprocket 214 and shares the same axis of rotation. The second gear 264 fixed to the at least one guide wheel 250. The first link 270 has a first end 274 and a second end 276. The first link 270 is sized to rotatably support the first gear 262, the third gear 266 and the fourth gear 268 in engagement. That is, the first link 270 is long enough so that the first gear 262, the third gear 266 and the fourth gear 268 may be rotatably mounted thereon, but not so long that the first gear 262, the third gear 266 and the fourth gear 268 fail to operatively engage each other. The second link 272 has a first end 278 and a second end 280. The second link 272 is sized to support the second gear 264 and the fourth gear 268 in operative engagement. The first link first end 274 is rotatably coupled to the lower case 222 with an axis of rotation corresponding to the sprocket 214 axis of rotation. The second link first end 278 is rotatably coupled to the upper case with an axis of rotation corresponding to the at least one guide wheel 250 axis of rotation. Further, the first link second end 276 and the second link second end 280 are rotatably coupled together and share an axis of rotation with the fourth gear 268. In this configuration, the drive assembly gear assembly 260 is structured to maintain the gears 262, 264, 266, 268 in operative engagement at the two links 270, 272 and rotate relative to each other about the second end 276, 280 joint. The two links 270, 272 rotate relative to each other about the second end 276, 280 joint as the upper case 220 and the lower case 222 move as described above. Thus, in this configuration, regardless of the spacing between the upper case 220 and the lower case 222, the sprocket 214 and the at least one wheel 250 remain operatively coupled via the operative engagement of the gears 262, 264, 266, 268.

Having described the drive assembly 54 and elongated rail 56 it can be seen that the rail 56 passes through the path between the drive assembly sprocket 214 and guide wheels 250 while the rail 56 is engaged by the sprocket 214. As the drive assembly motor 210 rotates the sprocket 214, the rail 54 is moved in or out of the steam generator 10. Further, it is noted that when the rail 56 is segmented, the rail assemblies 90 may be attached to each other during the cleaning procedure. That is, to clean the tubes 24 closest to the inspection opening 32, a single rail assembly 90 is coupled to a nozzle assembly 58 and to the water manifold 92. The rail 56 is then passed through the drive assembly 54 and the nozzle assembly 58 is inserted into the steam generator 10 and the tubes 24 cleaned. The water manifold 92 does not pass through the drive assembly 54. Thus, once the tubes 24 closest to the inspection opening 32 are cleaned, the water manifold 92 may be decoupled from the first rail assembly 90, a second rail assembly 90 may then be coupled to the first rail assembly 90, and the water manifold 92 is recoupled to the second rail assembly 90. The rail 56 is now longer and the rail body first end 74 may be moved further into the steam generator 10. This procedure may be repeated by adding additional rail assemblies 90 until the rail 56 has a sufficient length to extend across the steam generator 10.

Figure 15:
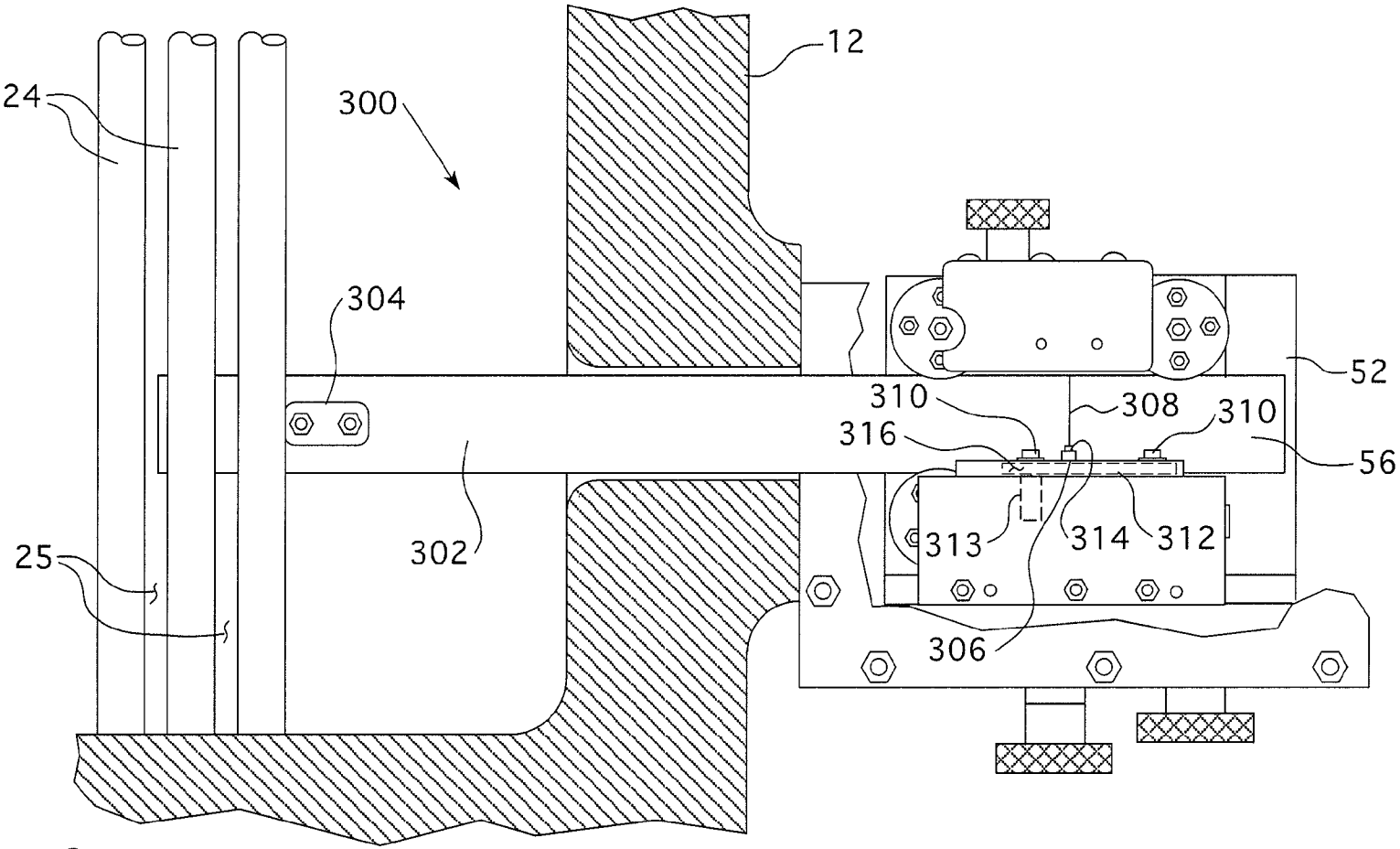
FIG. 15 is a detailed side cross-sectional view of the steam generator showing the positioning assembly.

Before, the cleaning operation occurs, however, it is desirable to align the nozzles 600 with the tube gaps 25. That is, as noted above, for the cleaning spray to reach as many tubes 24 as possible, it is desirable for the spray to be substantially aligned with the center of the tube gaps 25. Further, as different inspection openings 32 may be spaced differently from the adjacent tubes 24, the location of the tubes 24 must be determined prior to inserting the rail 56 with a nozzle assembly 58. Thus, as shown in FIG. 15, the rail 56 may have an a positioning assembly 300 temporarily coupled thereto. The positioning assembly 300 includes a body 302, stop 304, an adjustable pointer assembly 306 and a plurality of indicia 308 (FIG. 4). The positioning assembly body 302 is substantially similar in dimensions to a rail assembly body 96, but does not include internal passages. The positioning assembly body 302 is coupled to the first end of the rail 56 and becomes the rail first end 74. The stop 304 is coupled to the positioning assembly body 302, i.e. to the rail first end 74. The stop 304 is sized so as to not pass between adjacent tubes 24. The adjustable pointer assembly 306 is movably coupled to the drive assembly 54 adjacent the rail 56 and is structured to move in a direction substantially parallel to the longitudinal axis of the rail 56. The plurality of indicia 308 are disposed on the rail 56. The indicia 308 are, preferably, lines, or line segments, extending across the rail body outer face 190. The indicia 308 are spaced as a multiple of the tube centerline distance, preferably the multiple is one. Further, the distance between the stop 304 and the indicia 308 is known and structured so that, when the stop contacts a tube 24, the indicia are a known distance from the tube 24 centerline and/or the centerline of the tube gap 25.

In this configuration, the positioning assembly body 302 is inserted into the steam generator as described above, however, instead of passing between the tubes 24, the stop 304 will contact the tube 24 closest to the inspection opening 32. The location of the tube 24 closest to the inspection opening 32 can therefore be determined. Once the location of the tube 24 closest to the inspection opening 32 are known, the adjustable pointer assembly 306 is positioned to match one of the indicia 308. The adjustable pointer assembly 306 is then temporarily fixed at that location. The rail 56 is then withdrawn from the steam generator 10 and the nozzle assembly 58 is attached to the rail 56. The rail 56 is reinserted into the steam generator 10 and the rail 56 is moved until the adjustable pointer assembly 306 again is aligned with an indicia 308. In this configuration, the nozzles 600 will be disposed substantially at the tube gap 25 centerline. After a cleaning spray is applied, the rail 56 may then be indexed (moved) forward until the adjustable pointer assembly 306 is aligned with the next indicia 308 indicating that the nozzles 600 are now disposed at the next tube gap 25. This operation may be repeated until all tube gaps 25 have been cleaned. Where the rail 56 includes a number of rail assemblies 90, the at least one indicia 308 includes a plurality of indicia 308 is disposed on each rail assembly 90.

The adjustable pointer assembly 306 includes at least one fastener 310 and an elongated body 312 having an indicator 314 thereon. Further, the drive assembly 54 includes at least one fastener opening 313 adjacent the rail 56. The adjustable pointer assembly body 312 has a longitudinal slot 316 therein. The adjustable pointer assembly 306 at least one fastener 310 is disposed through one the adjustable pointer assembly body slot 316 and coupled to the drive assembly 54 at least one fastener opening 313. Thus, the adjustable pointer assembly body 312 is movably coupled to the drive assembly 54 and may be moved longitudinally as well as temporarily fixed thereto.

The nozzle assembly 58 may include essentially fixed nozzles, hut preferably includes movable nozzles 600 so as to increase the effective cleaning area to which water may be applied. Motion of the nozzles 600 is generated by an oscillator assembly 330 (FIG. 4). The oscillator assembly 330 is structured to produce a cyclic motion and is operatively coupled to the drive shaft 72. Thus, the drive shaft 72 moves cyclically as well. As shown in FIGS. 3, 4 and 8, the oscillator assembly 330 (FIG. 4) includes a housing assembly 332, a motor assembly 334 (FIG. 4) having an elongated output shaft 336 and a gear assembly 338. The oscillator assembly motor assembly 334 is coupled to the oscillator assembly housing assembly 332. The oscillator assembly motor assembly 334 may include a control assembly 450 and a sensor assembly 452 having an encoder 454 and a mechanical resistance sensor 456, all shown schematically and detailed below. The oscillator assembly motor assembly 334 is structured to rotate the output shaft 336 in two directions. That is, the oscillator assembly motor assembly 334 may rotate the oscillator assembly motor output shaft 336 in two directions.

As noted above, the sludge lance 50 often must be operated in a tight quarters. As such, while the longitudinal axis of oscillator assembly motor assembly 334 and/or output shaft 336 could be aligned with the longitudinal axis of the drive shaft 72, it is preferable for the oscillator assembly 330 to extend about perpendicular to the longitudinal axis of the drive shaft 72, thereby reducing the overall length of the sludge lance 50. Thus, the oscillator assembly gear assembly 338 is, preferably, a miter gear assembly. The oscillator assembly gear assembly 338 has a first gear 340 a second gear 342, and a miter gear socket member 343. The oscillator assembly gear assembly first and second gears 340, 342 are operatively coupled. The first gear 340 is fixed to the oscillator assembly motor output shaft 336. The second gear 342 is coupled to the miter gear socket member 343 which defines a keyed opening 344. That is, for each embodiment of the nozzle assembly 58A, 58B, the oscillator assembly gear assembly 338 has a different miter gear socket member 343. The miter gear socket member 343 has a tubular portion 350 and a generally perpendicular flange 352. The miter gear socket member tubular portion 350 is disposed within the central opening of the second miter gear 342. The miter gear socket member tubular portion 350 is hollow and defines a key socket. The miter gear socket member flange 352 includes fastener openings 354 which are aligned with threaded bore holes 356 in the second miter gear 342. It is noted that, rather than using the miter gear socket member 343 so as to make the assembly adaptable for use with both embodiments of the nozzle assembly 58A, 58B, the second gear 342 may be formed with a specific opening (not shown) for use with only one nozzle assembly 58A, 58B. Accordingly, as used herein, the "second gear [with a] keyed opening" shall mean the second gear 342 with the associated miter gear socket member 343 or the equivalent structure of a second gear 342 having a keyed opening.

The drive shaft second end 84 extends from the rail body 70 and, as noted above, the outer perimeter may be a keyed extension 134 or coupled to a key 134 for a keyed opening. That is, in the first embodiment, the drive shaft second end 84 is a key and in the second embodiment the drive shaft second end 84 is threaded and passed through a nut 570. As used herein, the nut 570 is a movable part of the drive shaft second end 84 so this configuration is the same as the drive shaft second end 84 being a key sized to correspond to the miter gear socket member keyed opening 344.

For either type of drive shaft keyed second end 346, the drive shaft 72 may move through the second gear keyed opening 344. That is, if the drive shaft second end 84 is not threaded, the drive shaft second end 84, and more specifically the drive shaft keyed second end 346 may slide through the second gear keyed opening 344. If the drive shaft second end 84 is threaded, rotation of the threaded collar 570 causes the drive shaft 72 to move through the threaded collar 570, and the drive shaft 72 moves through the second gear keyed opening 344. Thus, the drive shaft keyed second end 346 is disposed in the second gear keyed opening 344 and the drive shaft 72 may move axially through the second gear 342.

Both embodiments of the nozzle assembly 58A, 58B include an elongated nozzle assembly body 400, 500. As noted above, there are preferably at least two lateral nozzles 600. The nozzles 600 are in fluid communication with the nozzle assembly body water passage 401 and the at least two lateral nozzles 600 are structured to move relative to the rail 56. That is, the nozzle assembly body 400, 500 is coupled to the drive shaft 72 and movement of the drive shaft 72 causes the nozzle body 400, 500 to move relative to rail 56.

In one embodiment, the nozzle assembly 58A provides for rotating nozzles 600. That is, as shown in FIG. 6, the nozzle assembly body 400 is an elongated, substantially hollow, substantially linear tube 402 having a first end 404, a medial portion 406 and a second end 408. The nozzle assembly body 400 defines the nozzle assembly body water passage 401. The nozzle assembly body 400 is structured to be rotatably coupled to the rail 56, or in the case of a segmented rail, to the head assembly 170, with the nozzle assembly body second end 408 and nozzle assembly body medial portion 406 disposed within the rail body 70 (or within the head assembly body 172) and the nozzle assembly body first end 404 extending from the rail first end 74 (or extending from the head assembly body first end 174).

In this embodiment, the nozzles 600 are generally perpendicular extensions 403 from the nozzle assembly body 400. There are preferably six nozzles 600, with three nozzles 600 extending parallel to each other in a first direction, and three other nozzles 600 extending in the opposite direction. The opposing nozzles 600 preferably share a substantially common axis. Further, the combined length of the opposing perpendicular extensions 403 have a greater width than the tube gap 25 through which the rail 56 is inserted. Thus, the longitudinal axis of the perpendicular extensions 403 must be oriented in a direction substantially parallel to the longitudinal axis of the tubes 24 during insertion, as well as any subsequent longitudinal movement, of the rail 56. During cleaning, nozzle assembly body 400, and therefore the perpendicular extensions 403, are rotated, up to about 180 degrees, so as to provide a greater cleaning area. That is, the oscillator assembly motor assembly 334 is structured to reciprocate the drive shaft 72 as follows. First the oscillator assembly motor assembly 334 moves the drive shaft 72 up to about ninety degrees in a first direction. The oscillator assembly motor assembly 334 then returns the drive shaft 72 to its original orientation. The oscillator assembly motor assembly 334 then moves the drive shaft 72 up to about ninety degrees in a second, opposite direction. This means that the perpendicular extensions 403 may travel over about 180 degrees. During this rotation, the perpendicular extensions 403 rotate into the tube gaps 25 between the tubes adjacent the rail 56. Further, the distal end of the nozzle assembly body 400 may include a soft, e.g. non-metallic, cap 409. This soft cap 409 protects the tubes 24 from damage if the rail 56 is not properly aligned with the tube gap 25 through which it is inserted. Further, the cap 409 preferably has a width, or diameter, that is greater than the rail body 70. Thus, the rail body 70 should be prevented from moving into a gap that is more narrow than the rail body 70. Further, the perpendicular extensions 403 may also include a nonmetallic sleeve 411. The sleeve 411 helps protect the tubes 24 if the nozzle assembly body 400 is not properly aligned with the perpendicular extensions 403 disposed at the tube gaps 25.

For this embodiment, the longitudinal axis of the nozzle body 400 is aligned with the drive shaft 72. Thus, the nozzle body 400 is offset from the rail body water passage 78 (or head assembly water passage 178) and would not be in fluid communication therewith. Accordingly, at the rail body first end 74 (or within the head assembly 170) there is a first end fluid passage 410 between rail body water passage 78 (or head assembly water passage 178) and the rail body drive shaft passage 80 passage (or the head assembly drive shaft passage 180). Further, there is at least one fluid port 412 in the nozzle assembly body medial portion 406. The nozzle assembly at least one fluid port 412 is positioned at said rail body first end fluid passage 410. The at least one fluid port 412 is in fluid communication with the nozzle body water passage 401. Thus, the at least one fluid port 412 allows for fluid communication between the rail body water passage 78 (or head assembly water passage 178) and the nozzle body water passage 401. Preferably, the edges of the at least one fluid port 412 are cut at an angle corresponding to the direction of the fluid flow so as to reduce turbulence.

In this configuration, the high pressure water is exposed to the drive shaft passage 80. To resist infiltration of water into the drive shaft passage 80, a seal is provided. More specifically, the nozzle assembly body medial portion 406 includes a solid portion 414 disposed between the nozzle body water passage 401 and the nozzle assembly body second end keyed socket 420, discussed below. The nozzle assembly body 400 includes a seal assembly 416 having a plurality of seals 415. The plurality of seals 415 are disposed about the nozzle assembly body 400 and are structured to substantially resist water escaping about the nozzle assembly body 400. The seal assembly 416 including at least a first seal 415A and a second seal 415B. The first seal 415A is disposed immediately adjacent the rail body first end 74 and is structured to resist water passing through said rail body first end 74. A bearing may be disposed at this location as well. The second seal 415B disposed about the nozzle assembly body solid portion 414 and structured to resist water passing through the drive shaft passage 80. The second seal 415B may include radial channels (not shown) structured to communicate water laterally. This type of seal 415B requires an exhaust passage 418 (FIG. 4) in the head assembly body 172. In this configuration, the water being forced down the drive shaft passage 80 may exit the head assembly body 172.

Further, the nozzle body 400 is structured to rotate about the nozzle body longitudinal axis thereby providing a greater coverage area for the cleaning spray. Preferably, the nozzle assembly body second end 407 defines a keyed socket 420. Further, as noted above, the drive shaft first end 82 is a key 134. The drive shaft first end key 134 corresponds to the nozzle assembly body second end keyed socket 420. Thus, when the nozzle body 400 is partially disposed in the rail body 70 (or head assembly body 170), the drive shaft keyed first end 134 is temporarily fixed to the nozzle body second end keyed socket 420 whereby rotation of the drive shaft 72 causes the nozzle body 400 to rotate.

There is potentially a nozzle assembly body 400 alignment problem when the rail 56 is formed from rail assemblies 90. That is, as discussed above, a user must know the orientation of the nozzle body 400 within the steam generator 10 as the nozzle body 400 may only be moved when the perpendicular extensions 403 are substantially parallel to the longitudinal axis of the tubes 25. When the drive shaft 72 is segmented and coupled by keyed extensions 134 and sockets 136, however, there is the potential for "play" in the couplings. The couplings each have a tolerance and, when the tolerance is multiplied by the number of couplings, the effect of the combined tolerances may be too significant. That is, the combined tolerances may allow the perpendicular extensions 403 to be in the tube gaps 25 when the drive shaft second end 84 is in its original orientation, i.e. when the nozzle body 400 was properly aligned during insertion.

To address this problem, the keyed extensions 134 and sockets 136 are tapered and the drive shaft 72 is biased toward the drive shaft first end 82. A keyed extension 134 is shown in FIG. 7. It is understood that the keyed socket 136 has a corresponding shape. The keyed socket 136 is tapered, having its major (larger) cross-sectional area immediately adjacent the drive shaft segment 94 and the minor (smaller) cross-sectional area distal to the drive shaft segment 94. Further, as described below, the drive shaft 72 is biased toward the drive shaft first end 82 by a plunger 434 described below. This bias reduces/controls the "play" between the drive shaft segments 94. To ensure a tight fit between each keyed extension 134 and keyed socket 136, the keyed extension 134 may have a taper that between about 0.0 degrees and 4.0 degrees, and more preferably about 2.0 degrees sharper than the taper of the socket 136. As noted above, the drive shaft 72 is structured to slide through the oscillator assembly second gear keyed opening 344, as described above, and it is desirable to bias the drive shaft 72 forward so as to bias the keyed extensions 134 into the keyed sockets 136. As shown in FIG. 8, this is accomplished by a keyed socket insert assembly 430 on the oscillator assembly housing assembly 332. The keyed socket insert assembly 430 is structured to engage the drive shaft 72 and bias the drive shaft 72 toward the rail body first end 74. The keyed socket insert assembly 430 includes a generally tubular, keyed body 432, a plunger 434, a biasing device 436, and a cap 438. The keyed socket insert assembly body 432 outer radial surface is shaped to correspond to the second gear keyed opening 344. The keyed socket insert assembly body 432 further has an elongated keyed passage 440. The keyed socket insert assembly body keyed passage 440 is structured to correspond to the drive shaft keyed second end 84. The keyed socket insert assembly plunger 434 is disposed in the keyed socket insert assembly body elongated passage 440. The keyed socket insert assembly cap 438 is coupled to the keyed socket insert assembly body 432 at the back end of the keyed socket insert assembly body elongated passage 440. The keyed socket insert assembly biasing device 436, which is preferably a compression spring 437, is disposed between the keyed socket insert assembly plunger 434 and the keyed socket insert assembly cap 438 and is structured to bias the keyed socket insert assembly plunger 434 toward rail body first end 74. Thus, the keyed socket insert assembly plunger 434 engages the drive shaft 72 thereby biasing the drive shaft 72 toward the rail body first end 74.

As noted above, the perpendicular extensions 403 must be oriented in a direction substantially parallel to the longitudinal axis of the tubes during insertion, as well as any subsequent longitudinal movement, of the rail 56. Generally, the orientation of the perpendicular extensions 403 is monitored by the oscillator assembly motor control assembly 450 (shown schematically in FIG. 3). That is, the oscillator assembly motor control assembly 450 is structured to receive input, typically an electronic signal carrying data, from the sensor assembly 452. The sensor assembly 452 (shown schematically in FIG. 3) includes an encoder 454 (shown schematically in FIG. 3) structured to track the orientation of the drive shaft 72 as well as a mechanical resistance sensor 456 (shown schematically in FIG. 3) The resistance sensor 456 is, typically, a current sensor that detects the amount of current being used by the oscillator assembly motor assembly 334. Both the encoder 454 and the mechanical resistance sensor 456 generate the input received by the oscillator assembly motor control assembly 450. That is, oscillator assembly motor assembly 334 is actuated in response to input, e.g. input from an operator, and to receive input from the encoder 454 and the resistance sensor 456. The encoder 454 is structured to track the position of the gears in the oscillator assembly gear assembly 338 and to provide position data to the oscillator assembly motor control assembly 450. As the oscillator assembly gear assembly 338 is in a fixed orientation relative to the drive shaft 72, the orientation of the drive shaft 72 is known as well. It is noted that the encoder 454 is reset each time the rail 56 is inserted into the steam generator after the rail body 70 has been positioned in the proper orientation. As the oscillator assembly motor control assembly 450 is electronic, a loss of power could cause the system to lose track of the orientation of the perpendicular extensions 403. This is not desirable as longitudinal movement of the rail 56 with the perpendicular extensions 403 in any orientation other than substantially aligned with the longitudinal axis of the tubes 24 could result in damage to the tubes 24. Accordingly, a nozzle orientation reset device 460 is included with the oscillator assembly 330.

Figure 16:
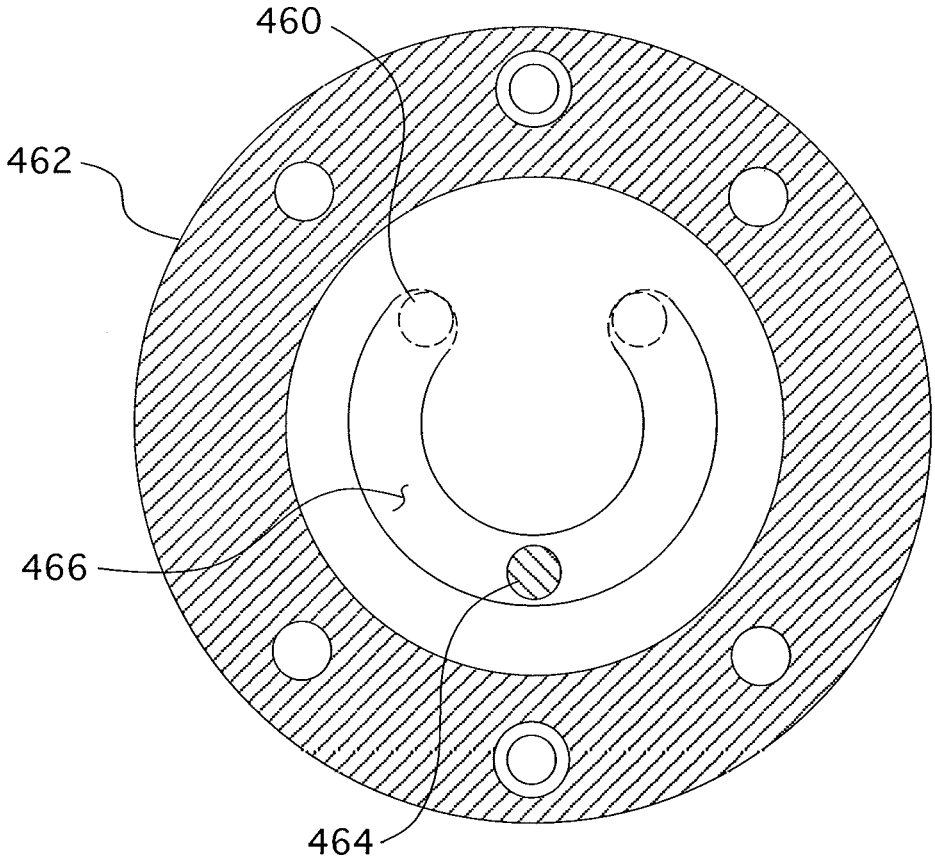
FIG. 16 is an end view of the nozzle orientation reset device.

The nozzle orientation reset device 460 is structured to position the nozzle assembly body 400, and therefore the perpendicular extensions 403 with the nozzles 600, in a selected orientation, typically vertically. The nozzle orientation reset device 460 includes an end plate 462 and a lug 464, as shown in FIG. 16. The end plate 462 is disposed adjacent to keyed socket insert assembly body 432. That is, the end plate 462 is disposed in a plane that is generally perpendicular to the axis of rotation of the drive shaft 72 adjacent the keyed socket insert assembly body 432 (FIG. 8). The end plate 462 has an arcuate channel 466 thereon. The end plate arcuate channel 466 has a center that is substantially aligned with the axis of rotation of the drive shaft 72. The lug 464 is disposed on the keyed socket insert assembly body 432 and extends axially therefrom. The lug 464 is sized and positioned to be movably disposed in the arcuate channel 466. Thus, as the oscillator assembly motor assembly 334 is actuated, the lug 464 reciprocates in the channel 466. The arcuate channel 466 extends over 180 degrees and, when the perpendicular extensions 403 are substantially aligned with the longitudinal axis of the tubes 24, the lug 464 is substantially centered in the channel 466.

The orientation of the nozzle assembly body 400 is reset, i.e. the oscillator assembly motor 450 is reset, by moving the lug 464 in the channel 466 until the lug 464 contacts one end of the channel 466. The oscillator assembly motor control assembly 450 is, preferably, programmed with data indicating the angular distance between the end of the channel 466 and the neutral position. When contact is made, the resistance sensor 456 provides position input data to the oscillator assembly motor control assembly 450 and the oscillator assembly motor control assembly 450 utilizes the encoder position data to reposition nozzles, i.e. the perpendicular extensions 403, in a selected, i.e. the neutral, orientation.

Figure 17:
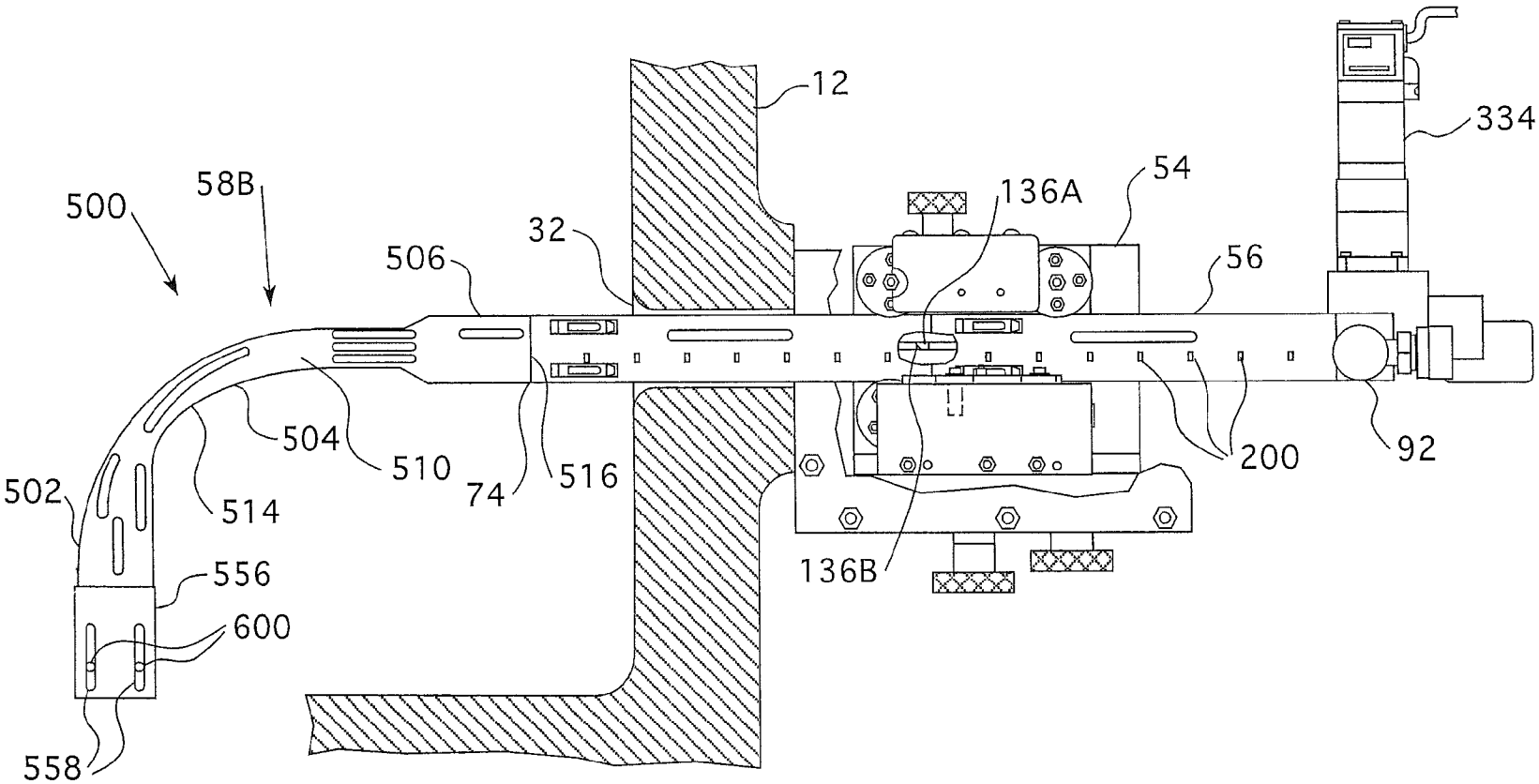
FIG. 17 is a detailed side cross-sectional view of the steam generator showing another embodiment of the miniature sludge lance.

In a second embodiment, shown in FIG. 17, the nozzle assembly 58B is structured to move the nozzles 600 vertically. That is, in the second embodiment the nozzle assembly 58B includes an elongated body assembly 500 having an elongated first end 502, a medial portion 504, and an elongated second end 506. The nozzle assembly body assembly medial portion 504 is arcuate, preferably extending over an arc of about ninety degrees, whereby the nozzle assembly body assembly first end 502 and the nozzle assembly body assembly second end 506 are disposed at about a right angle relative to each other. The nozzles 600 are disposed at the nozzle assembly body assembly first end 502. The nozzles 600 are structured to move vertically due to the nozzle assembly body assembly first end 502 being structured to collapse. That is, the nozzle assembly body assembly first end 502 is structured to move between a first position, wherein the nozzle assembly body assembly first end 502 is extended, and a second position wherein the nozzle assembly body assembly first end 502 is retracted. Preferably, in use, the nozzle assembly body assembly second end 506 extends generally horizontally from the rail 56 and the nozzle assembly body assembly medial portion 504 curves downwardly. In this configuration, when the nozzle assembly body assembly first end 502 is in the first position, the nozzles 600 are at a lower elevation than when the nozzle assembly body assembly first end 502 is in the second position.

Figure 18:
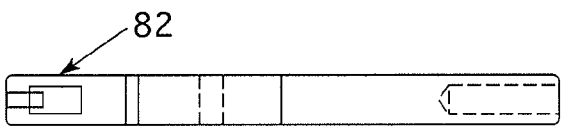
FIG. 18 is a detailed side cross-sectional view of the retraction assembly.
Figure 18:
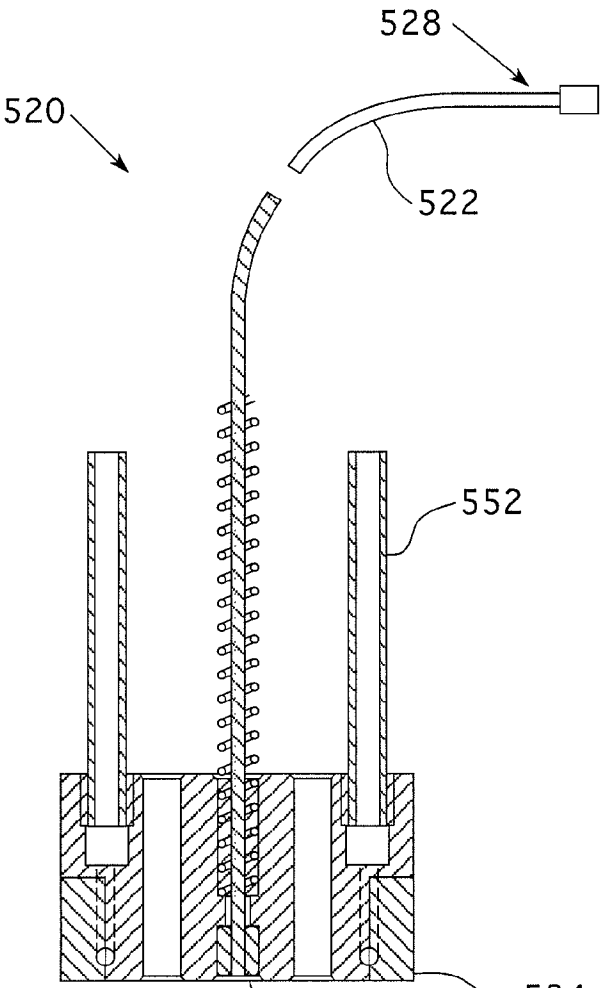
Figure 19:
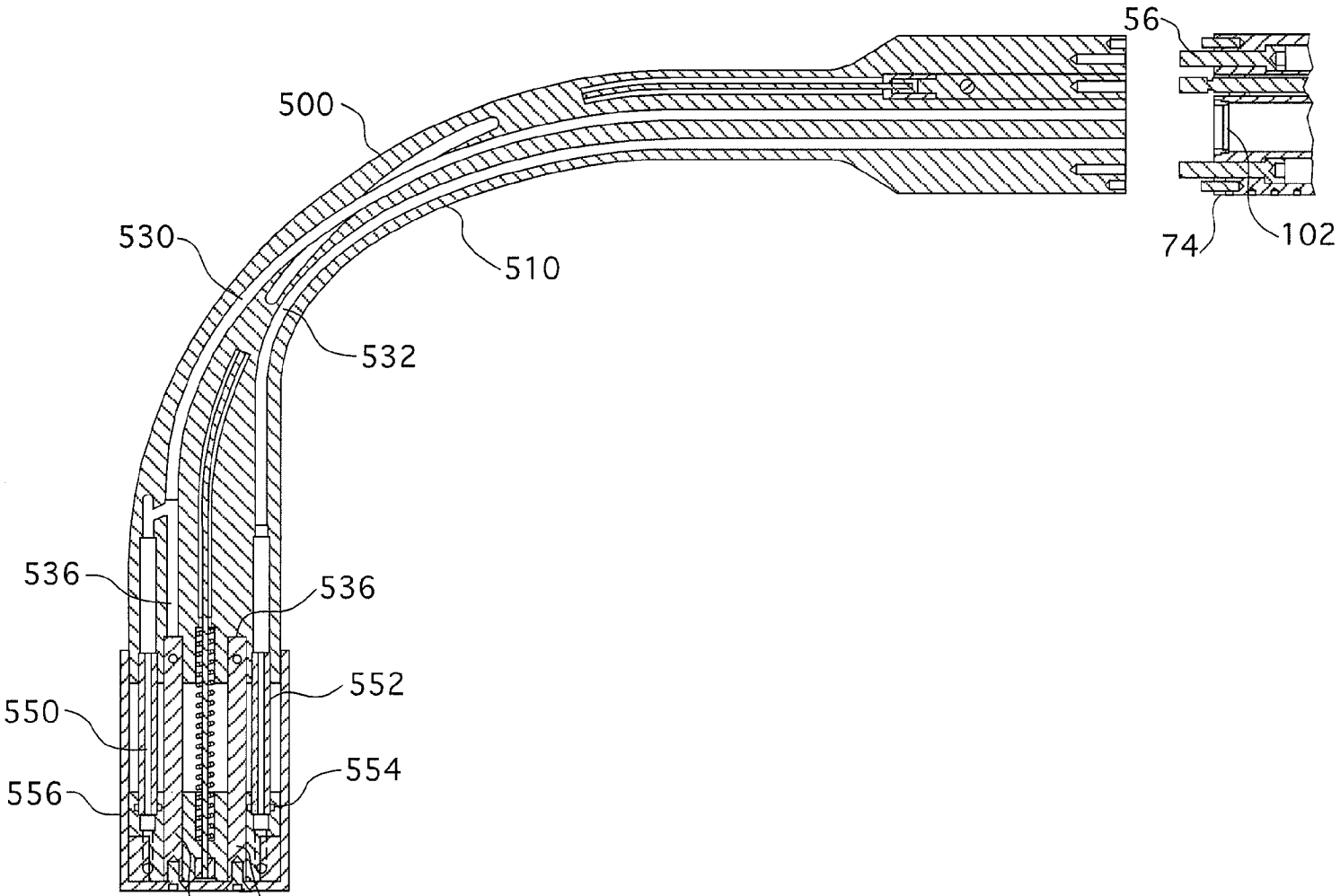
FIG. 19 is a detailed side cross-sectional view of the other embodiment of the miniature sludge lance.
Figure 20:
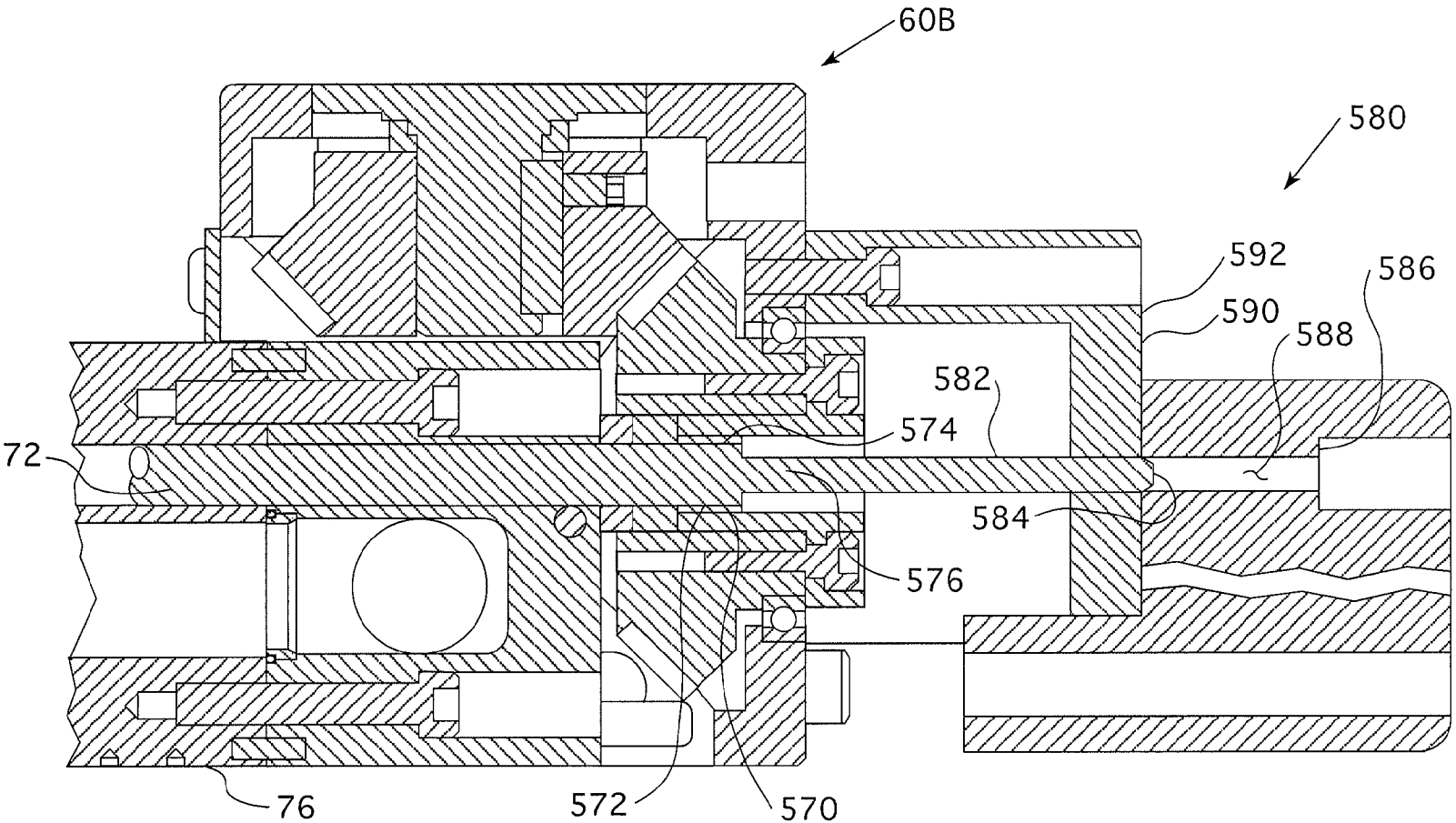
FIG. 20 is a detailed side cross-sectional view of the other embodiment of the oscillator assembly.

The nozzle assembly body assembly first end 502 may be structured to collapse via a bellows device but, in the preferred embodiment, movement of the nozzles 600 is accomplished by a retraction assembly 520 (FIG. 18). That is, the nozzle assembly body assembly 500 includes a body member 510 and the retraction assembly 520. The nozzle assembly body assembly body member 510 is a substantially rigid member having an elongated first end 502, a medial portion 514, and an elongated second end 516. The nozzle assembly body assembly body member medial portion 514 is arcuate, preferably extending over an arc of about ninety degrees, whereby the nozzle assembly body assembly body member first end 502 and the nozzle assembly body assembly body member second end 516 are disposed at about a right angle relative to each other. The retraction assembly 520 includes a cable 522 and a sliding head assembly 524. As shown in FIGS. 18 and 19, the sliding head assembly 524 is movably coupled to the nozzle assembly body assembly body member first end 502 and is structured to move longitudinally relative thereto. The retraction assembly cable 522 is movably disposed in the nozzle assembly body assembly body member 510 and is coupled to the sliding head assembly 524. In this configuration, movement of the retraction assembly cable 522 moves the sliding head assembly 524. The nozzles 600 are disposed on the sliding head assembly 524. Thus, movement of the sliding head assembly 524 relative to the nozzle assembly body assembly body member first end 502 is, generally, over a vertical axis.

The nozzle assembly body assembly body member 510 defines a number of passages. For example, in this embodiment, the nozzle assembly water passage 401 is divided into a first elongated high pressure channel 530 and a second elongated high pressure water channel 532. The first and second high pressure channels 530, 532 are disposed in the substantially the same plane and extend substantially parallel to each other. One or both of the high pressure channels 530, 532 may include a passage in fluid communication with the sliding head assembly body 544. In this configuration, the water pressure acts to bias the sliding head assembly body 544 into the first position, discussed below. Further, at the nozzle assembly body assembly body member first end 502 there are, preferably, two bores 536 structured to support a pair of guide shafts 540, 542.

That is, at the nozzle assembly body assembly body member first end 502 there are a pair of guide shafts, i.e. first and second guide shafts 540, 542, that extend outwardly therefrom and generally parallel to the nozzle assembly body assembly body member first end 502 longitudinal axis. The first and second guide shafts 540, 542 interact with the sliding head assembly 524. The sliding head assembly 524 further includes a body 544. The sliding head assembly body 544 is movably coupled to the sliding head assembly first and second elongated guide shafts 540, 542 and is structured to move between a first extended position, wherein the sliding head assembly body 544 is spaced from the nozzle assembly body assembly body member first end 502, and a second position, wherein the sliding head assembly body 544 is disposed closer to the nozzle assembly body assembly body member first end 502. Preferably, the sliding head assembly body 544 defines two passages 546 sized to correspond to the first and second guide shafts 540, 542. Thus, the sliding head assembly body 544 can be slidably coupled to the first and second guide shafts 540, 542. Further, the retraction assembly cable 522 is coupled to the sliding head assembly body 544. Thus, actuation of the cable 522 moves the sliding head assembly body 544 over the first and second guide shafts 540, 542 and relative to the nozzle assembly body assembly body member first end 502.

Figure 18A:
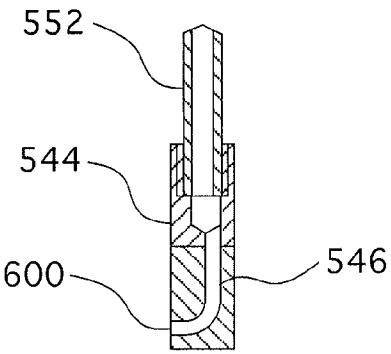
FIG. 18A is a detail of a cross-section side view of the sliding head assembly of FIG. 18.

The sliding head assembly body 544 further defines two water passages 546. The sliding head assembly body water passages 546 terminate in generally lateral nozzles 600, as shown in FIG. 18A. The nozzles 600 may open in the same direction, but could open in opposing directions or both lateral directions. The sliding head assembly 524 further includes a first elongated high pressure tube 550 and a second elongated high pressure water tube 552. The first and second high pressure tubes 550, 552 are coupled to said sliding head assembly body 544. The first and second high pressure channels 530, 532 are sized to accommodate the first and second high pressure tubes 550, 552. Further, each of the first and second high pressure tubes 550, 552 are coupled to, and in fluid communication with, one of the high pressure channel 530, 532 and one of the sliding head assembly body water passages 546. There are seals 554 disposed about the first and second high pressure tubes 550, 552 and are located between the first and second high pressure tubes 550, 552 and the first and second high pressure channels 530, 532. In this configuration, as the sliding head assembly body 544 moves between the first and second positions, the first and second high pressure tubes 550, 552 move in and out of the first and second high pressure channels 530, 532. Finally, it is noted that the sliding head assembly body 544 may be protected by a shell 556 that is disposed about the sliding head assembly body 544 and coupled to the nozzle assembly body assembly body member second end 516. The sliding head assembly body shell 556 has slots 558 (FIG. 17) therethrough that are aligned with, and extend over the path of travel of the nozzles 600.

It is noted that because the nozzle assembly 58B does not rotate as does the embodiment having nozzle assembly 58A; the motion of the drive shaft 72 must be a longitudinal motion. That is, in this embodiment, the drive shaft 72 is structured to move longitudinally within the rail 56 between a first position, wherein the drive shaft 72 extends from the rail body first end 74, and a second position, wherein the drive shaft 72 is shifted towards the rail body second end 76. Further, the drive shaft first end 82 is threaded coupling or another type of temporarily fixable coupling. The cable 522 has a first end 526 and a second end 528. The cable second end 528 is structured to be temporarily fixed to the drive shaft first end 82. The drive shaft first end 82 is temporarily coupled to the cable second end 528. Thus, the longitudinal movement of the drive shaft 72 causes the cable 522 to move longitudinally in the nozzle assembly body assembly body member 510.

The longitudinal motion of the drive shaft 72 is created by the oscillator assembly 330. The majority of the oscillator assembly 330 components are the same as above and like reference numbers will be used herein below. That is, the motor assembly 334 and the gear assembly 338 are substantially the same as described above. The notable difference between the prior embodiment and this embodiment is the connection with the drive shaft 72. In the prior embodiment, the drive shaft 72 is needed to rotate so as to rotate the nozzle assembly 58A. In this embodiment, the drive shaft 72 must be moved longitudinally. This is accomplished by having a threaded portion 576 on the drive shaft second end 84 and having a nut, or threaded collar 570, as described above, disposed between the drive shaft second end 84 and the oscillator assembly gear assembly 338.

That is, in this embodiment the drive shaft second end 84 includes a threaded collar 570. The threaded collar 570 has a keyed outer radial surface 572, preferably a square shape, and a threaded inner surface 574. The threaded collar outer radial surface 572 is shaped to correspond to the second gear keyed opening 344. The drive shaft second end 84 also has a threaded portion 576. The drive shaft second end threaded portion 576 extends beyond the rail body second end 76 so that it is exposed. The threaded collar 570 is disposed within the second gear keyed opening 344. In this configuration, actuation of the oscillator assembly motor assembly 334 causes the threaded collar 570 to rotate. Thus, as the drive shaft second end Threaded portion 576 is disposed in, and engaging, the threaded collar threaded inner surface 574, the rotation of the threaded collar 570 causes the drive shaft second end threaded portion 576 to translate through the threaded collar 570. This creates the longitudinal movement in the drive shaft 72.

For this configuration to operate, and not unscrew the drive shaft segments 94 from each other, the drive shaft 72 must not rotate. Further, there is still a need to know the configuration, and/or position, of the nozzle assembly body 500 in the event of a loss of power. That is, as noted above, the oscillator assembly motor assembly 334 includes an electronic oscillator assembly motor control assembly 450 that is structured to track the location of the nozzle assembly 58. As the oscillator assembly motor control assembly 450 is electric, a loss of power may cause the oscillator assembly motor control assembly 450 to lose data relating to the position of the nozzle assembly 58B. In this embodiment, both of these functions are accomplished by the oscillator assembly nozzle position reset device 580.

The nozzle position reset device 580 includes a drive shaft extension 582, a movable indicia 584, a fixed indicia 586 and a keyed opening 588. The drive shaft extension 582 extends longitudinally from the drive shaft second end 84. The drive shaft extension 582 is keyed and may be an elongated portion of the drive shaft second end 82 that extends beyond the drive shaft second end threaded portion 576. The movable indicia 584 is disposed on the drive shaft second end 84 and, more preferably, on the said drive shaft extension 582. The fixed indicia 586 is disposed adjacent to the drive shaft extension 582, and may simply be the outer surface of the oscillator assembly housing assembly 332. Preferably, when the sliding head assembly body 544 is in the first position, the two nozzle position reset device indicia 584, 586 are aligned. As the drive shaft 72 is moved longitudinally toward the rail body second end 76, thereby moving the cable 522 and the sliding head assembly body 544, the two nozzle position reset device indicia 584, 586 become spaced from each other. To reset the position of the sliding head assembly body 544, the two nozzle position reset device indicia 584, 586 must be realigned. That is, the oscillator assembly motor assembly 334 is actuated in the direction required to return the two nozzle position reset device indicia 584, 586 into alignment. Thus, comparing the location of the movable indicia 584 to the fixed indicia 586 indicates the position of the drive shaft 72 relative to the rail body 70. In a preferred embodiment, the oscillator assembly housing assembly 332 includes an offset end plate 590 that is spaced from the threaded collar 570 in an axial direction. The offset end plate 590 has the keyed opening 588 therethrough. The offset end plate opening 588 is sized to allow the drive shaft extension 582 to pass therethrough. The fixed indicia 584 is disposed on the offset end plate 590. Moreover, the keyed drive shaft extension 582 passing through the keyed opening 588 prevents the drive shaft 72 from rotating. Thus, as the threaded collar 570 rotates, the orientation of the drive shaft 72 is maintained and the interaction with the threaded collar 570 causes the drive shaft 72 to translate longitudinally.

Figure 21:
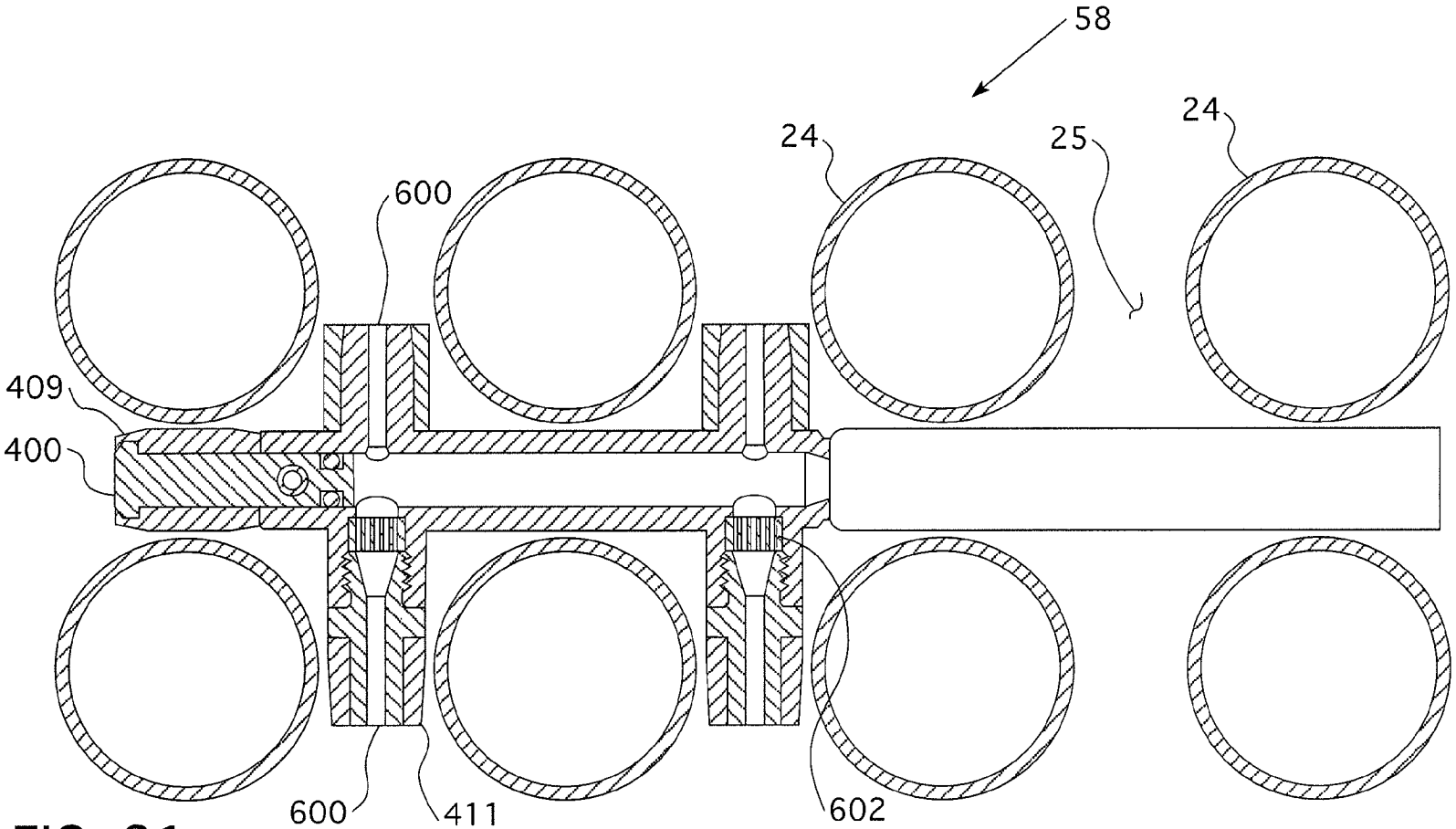
FIG. 21 is a detailed side cross-sectional view of a nozzle assembly.
Figure 22:
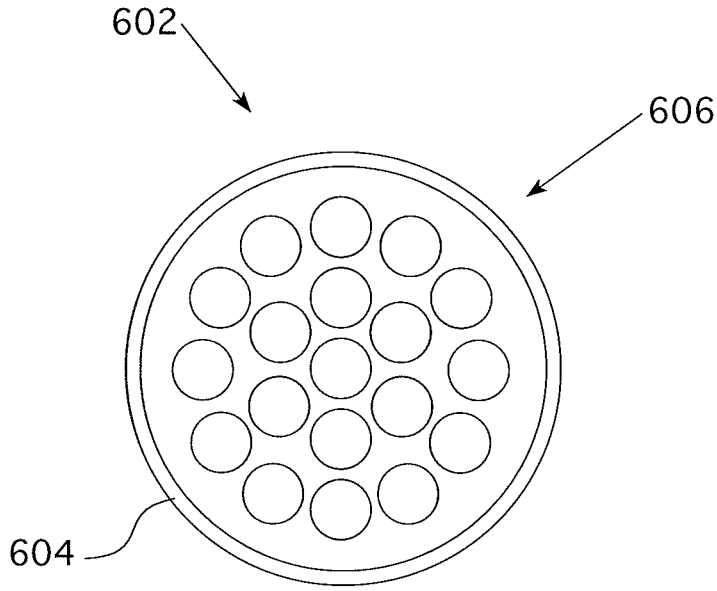
FIG. 22 is an end view of a flow straightener.

In both nozzle assembly embodiments 58A, 58B, the water flow must be turned about ninety degrees from the direction the water travels in the nozzle assembly body 400, 500, to the lateral direction that the nozzles 600 face, as shown in FIG. 21. This change in direction, especially if it is close to the nozzles 600, may create a turbulent flow resulting in an irregular spray pattern emerging from the nozzles 600. To return the water flow to a generally laminar flow, at least one flow straightener 602 is disposed in at least one nozzle 600. As shown in FIG. 22, the flow straightener 602 includes a body 604 having a plurality of passages 606 therethrough. The flow straightener passages 606 extend substantially parallel to each other. The at least one flow straightener body 604 is, preferably, a generally circular disk with the flow straightener passages 606 extending in an axial direction. Preferably, the flow straightener 602 is disposed in at least one said lateral nozzle 600, as opposed to a location upstream in the nozzle assembly body 400, 500. Preferably, each flow straightener body 604 is between about 0.1 and 0.2 inch in diameter, and more preferably about 0.15 inch in diameter. There are preferably between about ten and thirty flow straightener passages 606, and more preferably about nineteen flow straightener passages 606. The flow straightener passages 606 are between about 0.01 and 0.03 inch in diameter, and more preferably about 0.02 inch in diameter.

Figure 23:
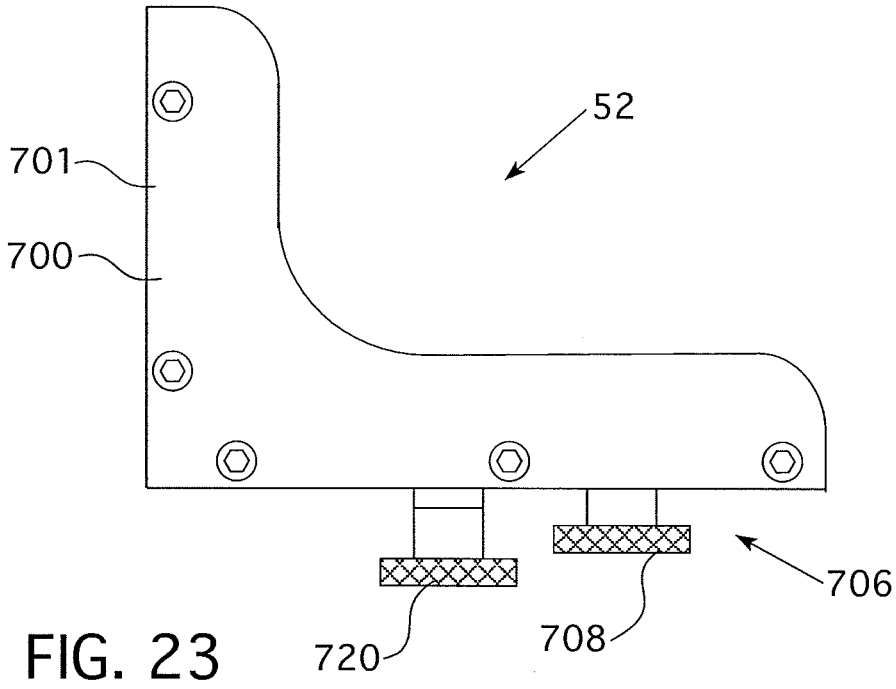
FIG. 23 is a side view of the mounting assembly.
Figure 24:
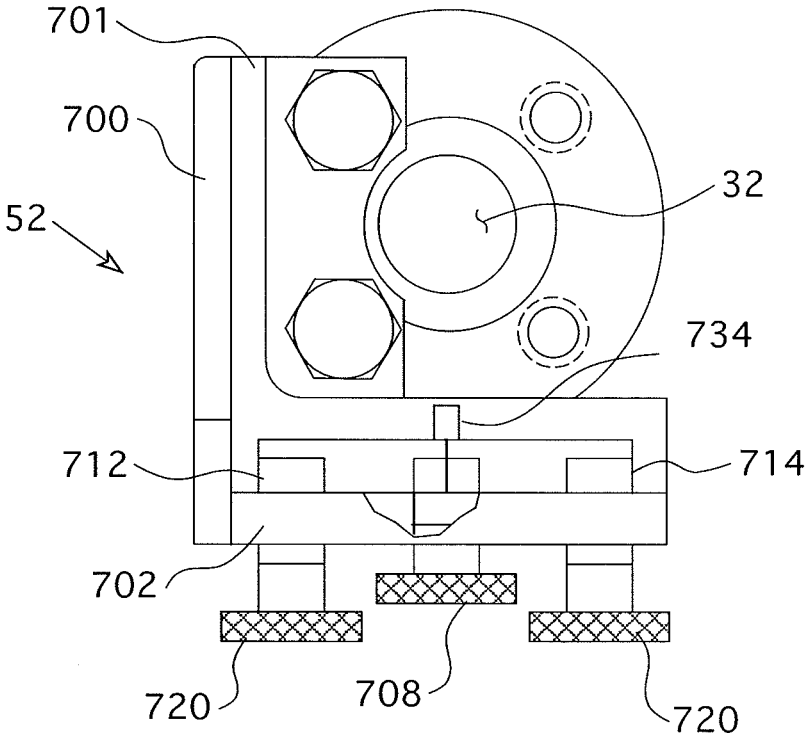
FIG. 24 is an end view of the mounting assembly.
Figure 25:
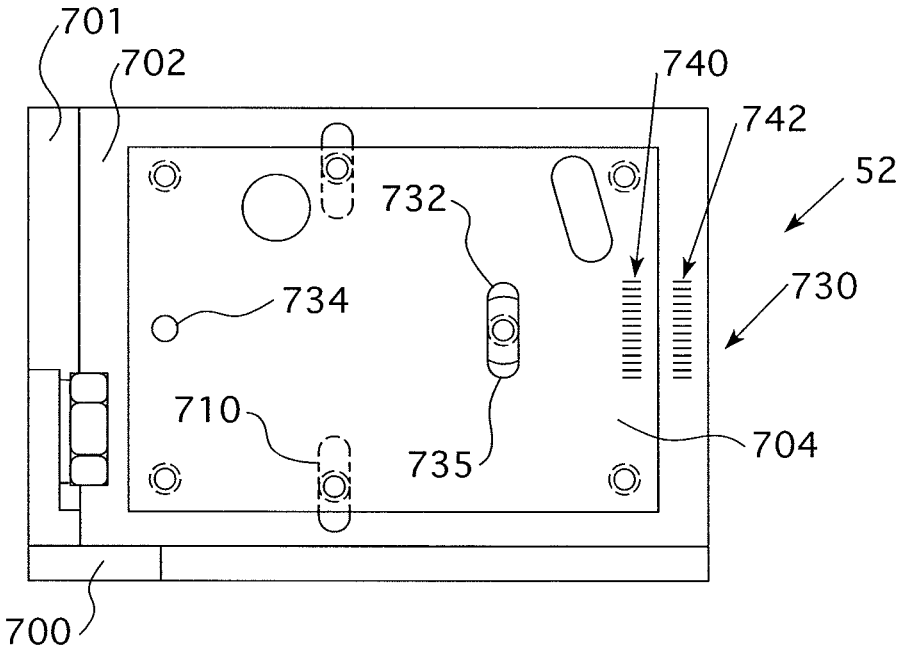
FIG. 25 is a top view of the mounting assembly.

The mounting assembly 52 is structured to be coupled to the steam generator 10 and to be adjustable so that the sludge lance 50, and more specifically the rail 56 may be aligned with a tube gap 25. Preferably, as shown in FIGS. 23-25, the mounting assembly 52 includes a "L" shaped mounting bracket 700 having a vertical, first plate 701, a horizontal, second plate 702, as well as a floating third plate 704, and a fastener assembly 706. The first plate 701 is structured to be coupled to the inspection opening 32. That is, the inspection opening 32 includes fastener holes used to secure a cover (not shown) to the inspection opening 32. The fastener assembly 706 includes fasteners 708 structured to pass through openings (not shown) in the first plate 701 and into the inspection opening 32 fastener holes. The second plate 702 is fixed to the first plate 701 at about a right angle. That is, the second plate 702 extends generally horizontally. The third plate 704 is movably coupled to the second plate 702. The fastener assembly 706 is structured to temporarily fix the third plate 704 to the second plate 702.

That is, the third plate 704 is structured to be adjustable relative to the inspection opening 32 and the second plate 702. For example, the second plate 702 includes two laterally extending slots 710 (FIG. 25). The third plate 704 include a first threaded opening 712 and second threaded opening 714 (FIG. 24). The first threaded opening 712 and the second threaded opening 714 are each structured to align with one of the second plate laterally extending slots 710 when the third plate 704 is disposed on top of the second plate 702. The fastener assembly 706 includes two threaded knobs 720. Each threaded knob 720 is structured to extend upwardly through one of the second plate laterally extending slots 710 and to be threaded into one of the third plate threaded openings 712, 714. In this configuration, the third plate 704 may be moved laterally relative to the second plate 702 and, when a proper position is reached, the threaded knobs 720 may be tightened thereby temporarily fixing the third plate 704 to the second plate 702.

Further, the angle of the rail's longitudinal axis relative to the inspection opening 32 may be adjusted. That is, the third plate 704 includes a drive assembly coupling 730. The drive assembly coupling 730 is structured to allow the drive assembly 54 to be rotated relative to the third plate 704. That is, the second plate 702 includes an arcuate slot 732 disposed on the longitudinal axis of the second plate 702. The third plate 704 has an upwardly extending lug 734 disposed on the longitudinal axis of the second plate 702. The third plate 704 also has an arcuate slot 735 disposed on the longitudinal axis of the third plate 704. The fastener assembly 706 includes a third threaded knob 720. The drive assembly 54 has two mounting openings, a first mounting opening 736, (FIG. 14) corresponding to the mounting assembly lug 734, and a threaded, second Mounting opening 738 (FIG. 14), corresponding to the threaded knob 720. The second mounting opening 738 is structured to align with the second plate arcuate slot 732 when the third plate 704 is disposed on the second plate 702. When assembled, the drive assembly 54 is disposed on the third plate 704 with the mounting assembly lug 734 disposed in the first mounting opening 736 and the threaded knob 720 disposed in, i.e. engaging, the threaded, second mounting opening 738. In this configuration, the drive assembly 54 may be rotated about the mounting assembly lug 734 until the desired angle is achieved. When the drive assembly 54 is aligned, the threaded knob 720 is passed through the second plate arcuate slot 732 and the third plate arcuate slot 735 and into the second mounting opening 738. To temporarily fix the drive assembly 54 to the third plate 704, the threaded knob 720 is tightened.

The second plate 702 and the third plate 704 may each have a set of indicia 740, 742 thereon. The mounting assembly indicia 740, 742 are, preferably, scales or a similar marking. The position of the mounting assembly indicia 740, 742 relative to each other may be recorded when the sludge lance 50 is successfully used (meaning the rail 56 is properly aligned with the tube gap 25). Thereafter, the second plate 702 and the third plate 704 may be pre-positioned relative to each other according to the recorded positioning the next time the sludge lance 50 is used at that inspection opening 32.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the invention, which is to be given the full breadth of the appended claims and any and all equivalents thereof.

What is claimed is:

1. A nozzle assembly for a for a sludge lance that is used in a steam generator, said steam generator having a shell defining an enclosed space, at least one primary fluid inlet port, at least one primary fluid outlet port, at least one secondary fluid inlet port, at least one secondary fluid outlet port, a plurality of substantially uniformly sized tubes extending between, and in fluid communication with, said at least one primary fluid inlet port and at least one primary fluid outlet port, said tubes disposed in a substantially regular pattern having substantially uniform, narrow gaps between at least some of adjacent tubes, said shell having at least one inspection opening disposed adjacent to said plurality of tubes, wherein said tubes in said plurality of tubes are arranged in rows and have a centerline and said tube centerlines in a given row are substantially uniformly spaced having a substantially uniform tube centerline distance between adjacent tubes, said sludge lance including a mounting assembly, a rail, a drive assembly and the nozzle assembly, said mounting assembly structured to support a drive assembly and said rail, said rail having an elongated body and a drive shaft, said rail body having a first end and a second end, said rail body sized to pass between adjacent tubes, said rail body defining a water passage and a drive shaft passage, said drive shaft rotatably disposed in said drive shaft passage, said rail body structured to be movably coupled to said drive assembly, said rail body having lateral sides, at least one rail body lateral side having a plurality of sprocket holes, said rail body water passage structured to be coupled to, and in fluid communication with, a water supply, said drive assembly structured to move the rail through said inspection opening, said drive assembly coupled to said mounting assembly, said nozzle assembly having a body assembly, said nozzle assembly body assembly sized to pass between adjacent tubes, said nozzle assembly body assembly defining a water passage, said nozzle assembly body assembly structured to be coupled to the rail body with said nozzle assembly body assembly water passage being in fluid communication with said rail body water passage, said sludge lance further including an oscillator assembly comprising:

a housing assembly, a motor having an elongated output shaft and a gear assembly;

said oscillator assembly motor coupled to said oscillator assembly housing assembly;

said oscillator assembly gear assembly having a first gear and a second gear, said first and second gears being operatively coupled;

said first gear fixed to said oscillator assembly motor output shaft;

said second gear having a keyed opening;

said drive shaft having a second end extending from said rail, said drive shaft second end being keyed;

said drive shaft keyed second end disposed in said second gear keyed opening;

whereby said drive shaft may move axially through said second gear;

said oscillator assembly motor structured to produce a cyclic motion; and said oscillator assembly operatively coupled to said drive shaft whereby said drive shaft moves cyclically;

said nozzle assembly body assembly includes an elongated body having an elongated first end, a medial portion, and an elongated second end;

said nozzle assembly body assembly medial portion being arcuate whereby said nozzle assembly body assembly first end and said nozzle assembly body assembly second end are disposed at about a right angle relative to each other;

a nozzle disposed at said nozzle assembly body assembly first end; and said nozzle assembly body assembly first end structured to collapse.

2. The sludge lance of claim 1 wherein:

said nozzle assembly body assembly includes a body member and a retraction assembly;

said nozzle assembly body assembly body member being substantially rigid and having an elongated first end, a medial portion, and an elongated second end;

said nozzle assembly body assembly body member medial portion being arcuate whereby said nozzle assembly body assembly body member first end and said nozzle assembly body assembly body member second end are disposed at about a right angle relative to each other;

said retraction assembly including a cable and a sliding head assembly;

said sliding head assembly movably coupled to said nozzle assembly body assembly body member first end and structured to move longitudinally relative thereto; and said retraction assembly cable movably disposed in said nozzle assembly body assembly body member and coupled to said sliding head assembly, whereby movement of said retraction assembly cable moves said sliding head assembly; and said nozzle which is disposed on said sliding head assembly.

3. The sludge lance of claim 2 wherein:

within said nozzle assembly body assembly body member, said nozzle assembly water passage is divided into a first elongated high pressure channel and a second elongated high pressure water channel, said first and second high pressure channels disposed in substantially the same plane and extending substantially parallel to each other;

said sliding head assembly including a body and at least a first and a second elongated guide shaft;

said sliding head assembly first and second elongated guide shafts coupled to, and extending from, said nozzle assembly body assembly body member first end, said first and second guide shafts disposed in the same plane and extending substantially parallel to each other, said first and second elongated guide shafts further extending substantially parallel to a longitudinal axis of said nozzle assembly body assembly body member first end;

said sliding head assembly body movably coupled to said sliding head assembly first and second elongated guide shafts and structured to move between a first extended position, wherein said sliding head assembly body is spaced from said nozzle assembly body assembly body member first end, and a second position, wherein said sliding head assembly body is disposed closer to said nozzle assembly body assembly body member first end; and wherein actuation of said cable moves said sliding head assembly body.

4. The sludge lance of claim 3 wherein:

said sliding head assembly includes a first elongated high pressure tube and a second elongated high pressure water tube, said first and second high pressure tubes being coupled to said sliding head assembly body;

said first and second high pressure channels being sized to accommodate said first and second high pressure tubes;

each said first and second high pressure tubes being coupled to, and in fluid communication with, one said high pressure channel and said nozzle; and wherein, as said sliding head assembly body moves between said first and second positions, said first and second high pressure tubes move in and out of said first and second high pressure channels.

5. The sludge lance of claim 2 wherein said drive shaft is structured to move longitudinally within said rail between a first position, wherein said drive shaft extends from said rail body first end, and a second position, wherein said drive shaft is shifted towards said rail body second end.

6. The sludge lance of claim 5 wherein:

said nozzle assembly body second end defines a threaded socket;

said cable has a first end and a second end, said cable second end being a threaded socket;

said drive shaft first end being threaded and sized to correspond to said nozzle assembly cable second end threaded socket.

7. The sludge lance of claim 6 wherein:

said oscillator assembly housing assembly includes a threaded collar, said threaded collar having a keyed outer radial surface and a threaded inner surface;

said threaded collar outer radial surface is shaped to correspond to said second gear keyed opening;

said drive shaft second end having a threaded portion, said drive shaft second end threaded portion extending beyond said rail body second end;

wherein said threaded collar is disposed within said second gear keyed opening, whereby actuation of said oscillator assembly motor causes said threaded collar to rotate; and said drive shaft second end threaded portion disposed in, and engaging, said threaded collar threaded inner surface, whereby rotation of said threaded collar causes said drive shaft second end threaded portion to translate through said threaded collar.

8. The sludge lance of claim 7 wherein said oscillator assembly includes a nozzle position reset device structured to identify the position of said sliding head assembly.

9. The sludge lance of claim 8 wherein:

nozzle position reset device includes a drive shaft extension a movable indicia, and a fixed indicia;

said drive shaft extension extending longitudinally from said drive shaft second end;

said movable indicia disposed on said drive shaft extension;

said fixed indicia disposed adjacent to said drive shaft extension; and wherein comparing the location of said movable indicia to said fixed indicia indicates the position of said drive shaft relative to said rail body.

10. The sludge lance of claim 9 wherein:

said oscillator assembly housing assembly includes an offset end plate spaced from said threaded collar in an axial direction;

said offset end plate having an opening therethrough, said offset end plate opening sized to allow said drive shaft extension to pass therethrough; and said fixed indicia is disposed on said offset end plate.

* * * * *

UNITED STATES PATENT AND TRADEMARK OFFICE

CERTIFICATE OF CORRECTION

PATENT NO. : 8,752,511 B2
APPLICATION NO. : 13/078026
DATED : June 17, 2014
INVENTOR(S) : Phillip J. Hawkins et al.

It is certified that error appears in the above-identified patent and that said Letters Patent is hereby corrected as shown below:

Title page, title, "MINATURE SLUDGE LANCE APPARATUS" should read---MINIATURE SLUDGE LANCE APPARATUS Signed and Sealed this
Twenty-fifth Day of August, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,752,511 B2
APPLICATION NO. : 13/078026
DATED : June 17, 2014
INVENTOR(S) : Phillip J. Hawkins et al.

It is certified that error appears in the above-identified patent and that said Letters Patent is hereby corrected as shown below:

Title page and in the Specification, Column 1, title, "MINATURE SLUDGE LANCE APPARATUS" should read---MINIATURE SLUDGE LANCE APPARATUS This certificate supersedes the Certificate of Correction issued August 25, 2015.

Signed and Sealed this
Tenth Day of November, 2015

Michelle K. Lee

Michelle K. Lee
*Director of the United States Patent and Trademark Office*